US006916278B2

(12) United States Patent
Webber

(10) Patent No.: US 6,916,278 B2
(45) Date of Patent: Jul. 12, 2005

(54) COMPOSITE MOTION EXERCISE MACHINE WITH MOVABLE LINKAGE SYSTEM

(76) Inventor: Randall T. Webber, 100 Harbor Dr., No. 1404, San Diego, CA (US) 92101

( * ) Notice: Subject to any disclaimer, the term of this patent is extended or adjusted under 35 U.S.C. 154(b) by 466 days.

(21) Appl. No.: 10/195,665

(22) Filed: Jul. 12, 2002

(65) Prior Publication Data

US 2004/0009855 A1 Jan. 15, 2004

(51) Int. Cl.[7] ..... A63B 21/068
(52) U.S. Cl. ..... 482/96; 482/72
(58) Field of Search ..... 482/72, 71, 95, 482/96, 112, 51, 140, 130, 90

(56) References Cited

U.S. PATENT DOCUMENTS

| | | | | |
|---|---|---|---|---|
| 4,004,801 A | | 1/1977 | Campanaro et al. | |
| 4,300,760 A | | 11/1981 | Bobroff | |
| 4,387,893 A | | 6/1983 | Baldwin | |
| 4,511,137 A | | 4/1985 | Jones | |
| 4,828,254 A | | 5/1989 | Maag | |
| 5,106,080 A | | 4/1992 | Jones | |
| 5,106,081 A | | 4/1992 | Webb | |
| 5,135,449 A | | 8/1992 | Jones | |
| 5,217,422 A | | 6/1993 | Domzalski | |
| 5,299,997 A | | 4/1994 | Chen | |
| 5,330,405 A | | 7/1994 | Habing et al. | |
| 5,346,447 A | | 9/1994 | Stearns | |
| 5,366,432 A | | 11/1994 | Habing et al. | |
| 5,409,440 A | | 4/1995 | Yang | |
| 5,484,365 A | | 1/1996 | Jones et al. | |
| 5,527,249 A | * | 6/1996 | Harris | 482/96 |
| 5,554,086 A | | 9/1996 | Habing et al. | |
| 5,580,340 A | * | 12/1996 | Yu | 482/96 |
| 5,603,678 A | | 2/1997 | Wilson | |
| 5,616,107 A | | 4/1997 | Simonson | |
| 5,620,402 A | | 4/1997 | Simonson | |
| 5,628,715 A | | 5/1997 | Simonson | |
| 5,658,225 A | * | 8/1997 | Huang | 482/72 |
| 5,722,917 A | | 3/1998 | Olschansky et al. | |
| 5,733,229 A | | 3/1998 | Dalebout et al. | |
| 5,899,836 A | | 5/1999 | Chen | |
| 5,928,116 A | | 7/1999 | Chiang | |
| 5,964,684 A | | 10/1999 | Sokol | |
| 6,015,369 A | | 1/2000 | Rasmussen | |
| 6,152,866 A | | 11/2000 | Kuo | |
| 6,206,809 B1 | * | 3/2001 | Habing et al. | 482/96 |
| 6,220,993 B1 | | 4/2001 | Sencil | |
| 6,264,588 B1 | | 7/2001 | Ellis | |
| 6,287,241 B1 | | 9/2001 | Ellis | |

OTHER PUBLICATIONS

Rower, Gym 80 Brochure, 2001.
Abdominal Multi–Joint Machine, Gym 80 Brochure, 2001.
Back Stretch Multi–Joint Machine, Gym 80 Brochure, 2001.
Leg Press Machine, Gym 80 Brochure, 2001.
Schwinn Natural Strength Advertisement, Date Unknown.

* cited by examiner

*Primary Examiner*—Jerome Donnelly
(74) *Attorney, Agent, or Firm*—Gordon & Rees LLP

(57) ABSTRACT

A composite motion exercise machine has a main frame, a user support, an exercise arm, a movable wedge, a connecting device, and a load. The user support and exercise arm are pivotally linked directly or indirectly to the main frame, and the movable wedge has first and second travel members in moving engagement with rails on the main frame and user support, respectively. The connecting device links the movable wedge to the exercise arm, such that movement of the exercise arm moves the wedge along the rails to lift the user support in an arcuate path away from the main frame.

25 Claims, 14 Drawing Sheets

COMPOSITE MOTION EXERCISE MACHINE WITH MOVABLE LINKAGE SYSTEM

BACKGROUND OF THE INVENTION

The present invention relates to composite motion exercise machines in which both the actuating member and the user support move in a dependent relationship, and is particularly concerned with an exercise machine using a movable linkage lifting system to displace the user support on actuation of the actuating member.

Exercise machines are divided into two major categories, single function and multi-function. A single function exercise machine performs one specific exercise to train a specific set of muscles. These machines are generally used in health clubs and gyms, where it is preferred for a user to perform one exercise on a specific machine for that exercise, and then to move on to another machine to perform a different exercise. Multi-function machines have different exercise stations for performing different exercises, using various muscle groups. Such machines are commonly used for in-home training, because of their space efficient design. Many types of single and multi-function machines have been designed in the past, most of which have a stationary seat or user support with a movable exercise arm or device linked to a load. Some have a stationary foot plate or actuating member and a movable user support.

Other, composite motion exercise machines are known in which both the actuating member and the user support move during exercise. In U.S. Pat. No. 5,330,405 of Habing et al., various exercise arms are attached to a movable user support sub-frame, which is connected to the main frame via a four bar linkage system. A lever arm is pivotally attached to the main frame and coupled through a cable and pulley system to the exercise arms and sub-frame. The lever arm has a movable carriage which bears against the lower links of the four bar linkage system. The load is supplied by the user's body weight, which can be increased or decreased by adjusting the position of the carriage along the lever arm and changing its contact point relative to the four bar linkage.

Other composite motion machines are described in U.S. Pat. No. 5,346,447 of Stearns, 5,733,229 of Dalebout et al., 5,928,116 of Chiang, and 6,015,369 of Rasmussen. U.S. Pat. Nos. 6,264,588 and 6,287,241 of Ellis describe a composite motion exercise machine comprising a main frame, slide rails attached to the main frame, an exercise arm pivotally secured to the main frame, a user engagement means attached to the exercise arm, a user support pivotally connected to the main frame, second slide rails attached to the user support, and a truck or slide linkage slidably engaged with the rails on the main frame and user support so that movement by the exercise arm moves the truck along the rails, forcing the user support to pivot and lift relative to the main frame. The load is attached to the user support. This requires two separate slide rails and linear bearings, increasing expense, and also requires a relatively long linear travel distance of the truck along the slide rails when the exercise arm is moved from the start to the ending position.

SUMMARY OF THE INVENTION

It is an object of the present invention to provide a new and improved composite motion machine with a movable linkage lifting system to transmit movement of an exercise member to movement of a user support.

According to one aspect of the present invention, a composite motion exercise machine is provided, which comprises a stationary main frame, a user support pivotally linked to the main frame, an exercise arm pivotally linked to the main frame, at least one first rail on the main frame, at least one second rail on the user support facing the first rail, a movable wedge assembly having a first traveling member in traveling engagement with the first rail and a second traveling member in traveling engagement with the second rail, and a connection device linking the movable wedge assembly to the exercise arm.

With this arrangement, when the user moves the exercise arm, the exercise arm will move the wedge assembly, and this will in turn displace the user support. The movable wedge assembly may have one or more rollers or wheels in moving engagement with the respective rails, or may instead be provided with a linear bearing or slide. Various types of connection devices may be used to pull the wedge, such as a line which may be a belt, cable, chain, rope, tie rod, or any other linking system. The load may be in the form of weight plates, a weight stack, air or hydraulic resistance, electric or magnetic resistance, tension springs, bands, or rods, or any other form of exercise resistance known in the field.

The exercise arm may have any suitable engagement means for engaging part of the user's body. The engagement means may be one or more handles, a strap, a roller, a pad, a flat foot plate, or the like, as is common in the field. The engagement means may be pivotally or fixedly attached to the exercise arm. When performing an exercise, the user may stand, sit, lie, or otherwise be supported by the user support in order to engage the exercise arm. The exercise arm may be pulled or pushed to perform exercises.

In some embodiments of the invention, the arrangement is such that the exercise arm will travel faster and over a greater distance than the user support and the load is connected to the user support. This produces a decrease in resistance felt by the user at the engagement area on the exercise arm, versus the true amount of the load applied at the user support. This decrease helps to reduce the inertia in the user support that builds during the exercise movement, and provides a more stable, comfortable exercise motion. It also allows the user to perform ballistic, explosive, or plyametric exercise movements while maintaining control of the load and exercise arm. Careful, controlled movements at reduced resistance are important and particularly beneficial in injury rehab, while explosive first step movements are often required for sports training. However, this invention also allows for arrangements in which the exercise arm and user support travel at the same speed and distance and for the resistance felt by the user to be 1:1 with the load. It is also possible for the user support to be arranged to move faster and farther than the exercise arm, and for the resistance felt by the user to be greater than a 1:1 ratio. The exercise machine of this invention can provide for all of these alternatives.

The composite motion exercise machine with a movable wedge lifting system provides an exercise movement that blends with the natural movement of the human body, providing a safer, more comfortable exercise. The position of the user support adjusts to the position of the exercise arm, and provides proper support based on that position. The movable wedge assembly does not require any pivotal connection between any parts, thus reducing expense and complexity.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 2:
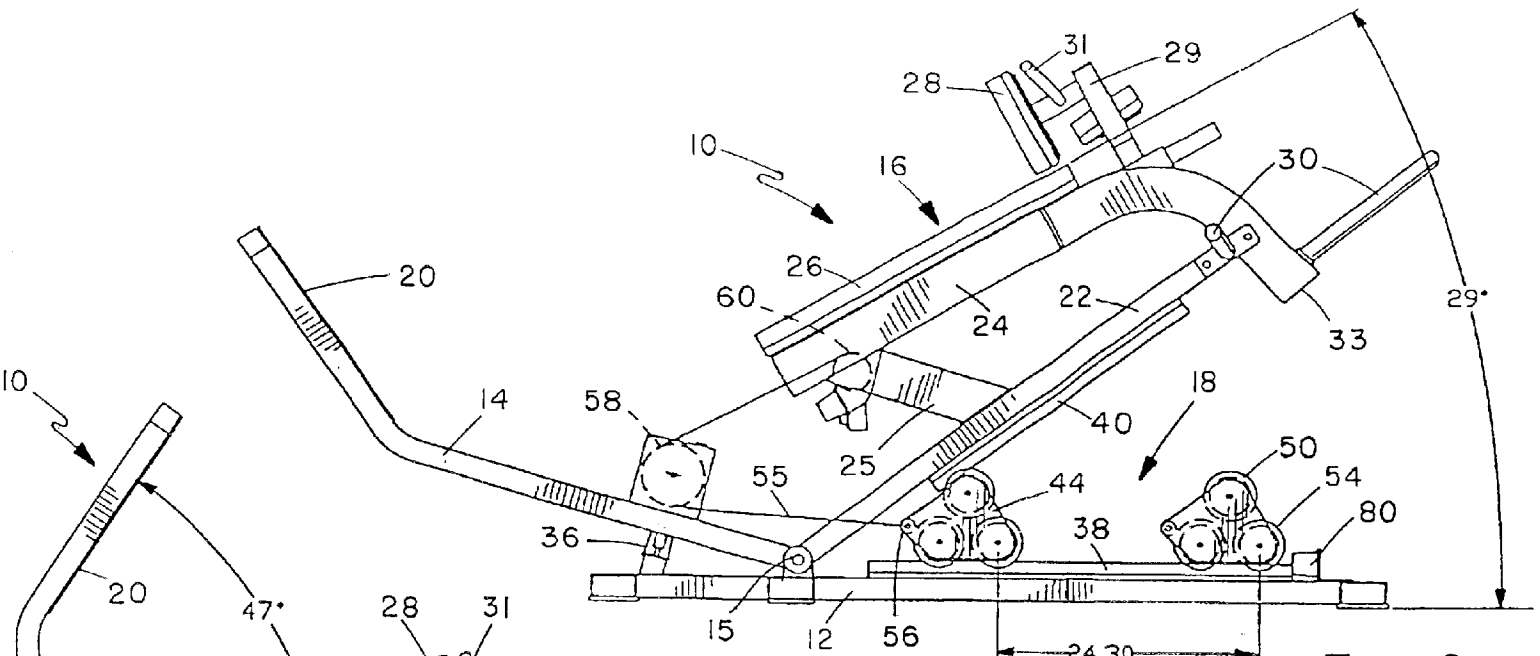
FIG. 2 is a side elevational view of the machine of FIG. 1, illustrating the fully extended position.
Figure 1:
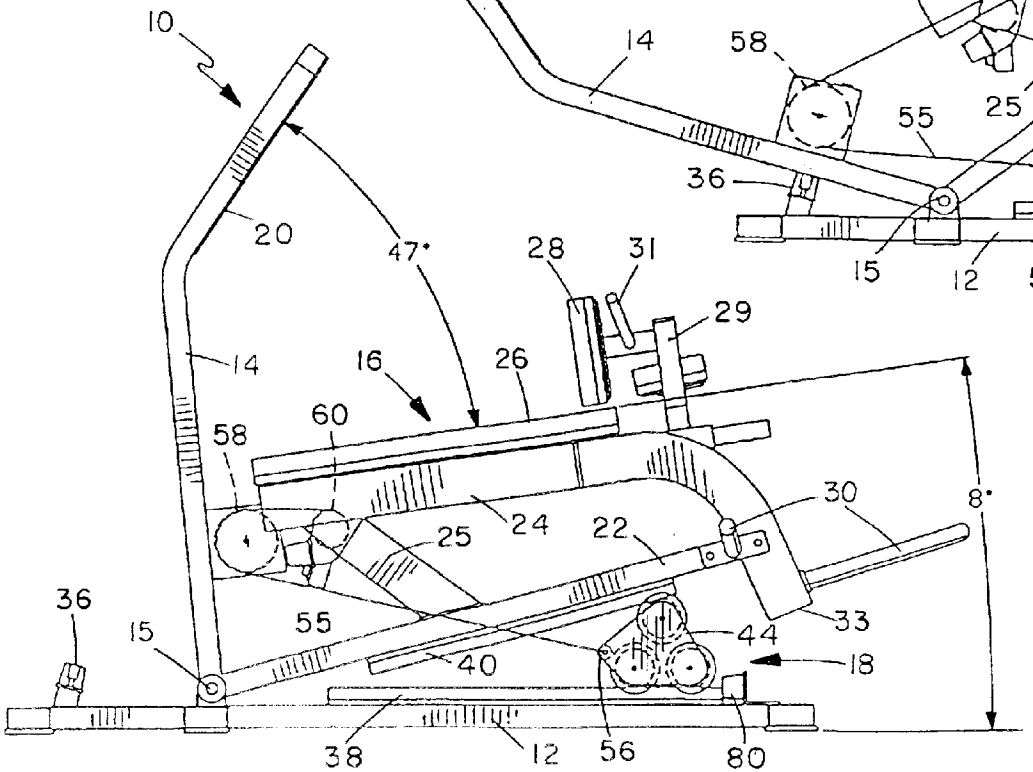
FIG. 1 is a side elevational view of a composite motion machine according to a first embodiment of the invention, showing the machine in a starting exercise position.

FIGS. 1 and 2 illustrate a composite motion exercise machine 10 according to a first embodiment of the present invention, while FIGS. 21 to 24 illustrate a movable wedge lifting system of the machine in more detail. The machine 10 has a main frame 12, an exercise arm 14 pivotally mounted on the frame for rotation about pivot axis 15, a user support 16 pivotally attached to the frame for rotation about the same pivot axis as exercise arm 14, and a movable wedge lifting or linkage system 18 linking the frame, exercise arm, and user support in the manner described below.

The machine 10 of FIGS. 1 and 2 is of the leg press type, and has a footplate 20 mounted adjacent the upper end of the exercise arm 14 facing the user support 16. The user support basically comprises a pair of spaced, parallel lower support bars 22 which each have a sleeve 23 at one end for rotating pivotal engagement with a respective pivot shaft on pivot axis 15, and an upper support member 24 connected to the support bars 22 via rigid links or struts 25. A seat or back pad 26 is mounted on top of support member 24 for the user to recline on, and an adjustable shoulder pad 28 is secured to the support member at the rear end of back pad 26 via support frame 29. The shoulder pad holds the user in place and provides bracing for their shoulders when performing a leg press exercise. Hand grips 31 are mounted on the shoulder pad assembly to provide added comfort when performing the exercise.

Load receiving weight pegs 30 are mounted at the rear of the user support 16. A first, vertical end stop post (not illustrated) at the rear end of the main frame will hold the user support in the starting position of FIG. 1, by engaging the lower end 33 of the support member 24. An end stop 36 at the forward end of the frame acts to support exercise arm 14 when in the fully extended position of FIG. 2.

Figure 21:
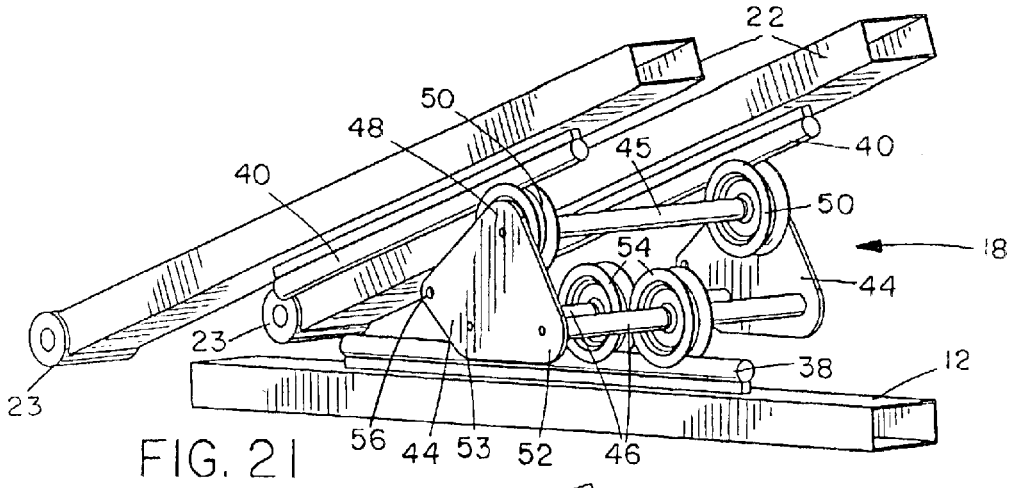
FIG. 21 is an enlarged perspective view of the movable wedge system of the machine of FIGS. 1 and 2.
Figure 22:
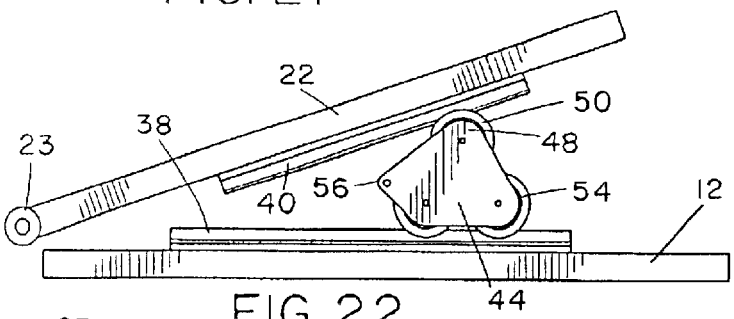
FIG. 22 is a side elevation view of the system of FIG. 21.
Figure 23:
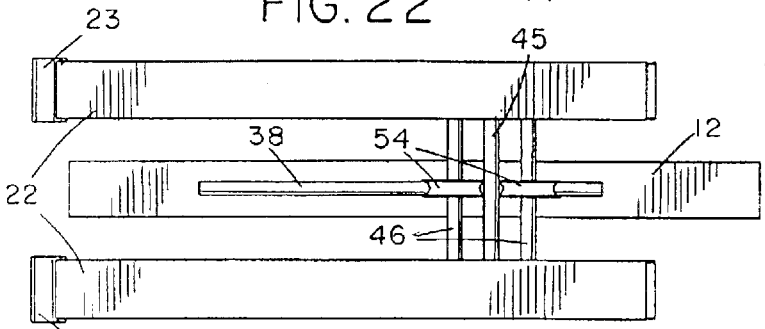
FIG. 23 is a top plan view of the assembly of FIGS. 21 and 22.
Figure 24:
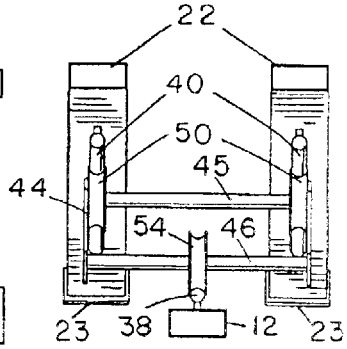
FIG. 24 is a rear view of the assembly of FIGS. 21 to 23.

The wedge linkage or lifting assembly between the main frame, user support, and exercise arm will now be described in more detail with reference to FIGS. 21 to 24. A slide or guide rail 38 is mounted on the main frame or base 12 beneath the user support, while a pair of slide or guide rails 40 are mounted one on each of the lower support bars 22. The wedge linkage system or assembly 18 is movably engaged with the three rails 38, 40, as best illustrated in FIG. 21. As indicated in FIG. 21, the wedge assembly 18 basically comprises a pair of parallel, generally wedge shaped plates 44 secured together by an upper connecting rod 45 and a pair of parallel, lower connecting rods 46. The first rod 45 extends between an upper apex 48 of each plate, and a roller or wheel 50 is rotatably mounted at each end of the rod for traveling engagement with a respective guide rail 40. The second rods 46 extend between the lower corners or apices 52, 53 of the plates. A single roller or wheel 54 is rotatably mounted at the center of each of the rods 46 for traveling engagement with the guide rail 38 on the support frame.

In the illustrated embodiment, the exercise arm 14 and each of the lower support bars 22 of the user support are separately pivoted to the main frame for rotation about separate but collinear pivot shafts. However, it will be understood that, in alternative embodiments, the support bars 22 and exercise arm 14 may be mounted for rotation on a single pivot shaft.

A line such as a belt or cable 55 is connected between the exercise arm 14 and each wedge plate 44, secured in an opening 56 provided in each plate for this purpose, as illustrated in FIGS. 1, 2 and 21. Each belt or cable 55 extends from the respective wedge plate around a respective pulley 58 provided on the exercise arm 14, and then secures to a respective tie-off 60 on the user support, as indicated in FIG. 1.

Figure 25:
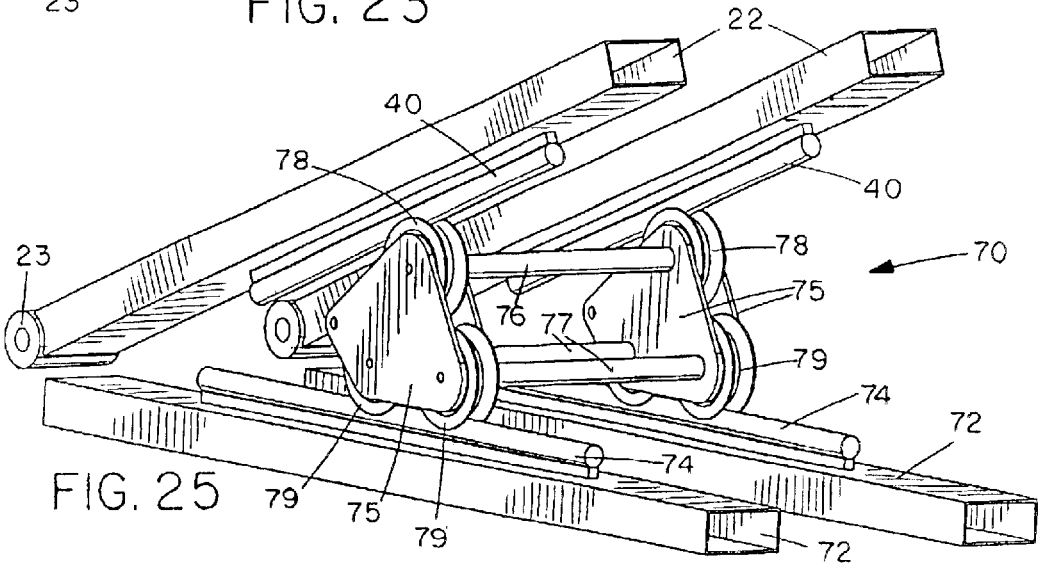
FIG. 25 is a perspective view of a modified movable wedge system that uses two rails on both the main frame and the user support.

FIG. 25 illustrates a modified wedge lifting or linkage system 70 which may be used in place of the system 18 of FIGS. 21 to 24. Some parts of the system in FIG. 25 are identical to the previous embodiment, and like reference numerals have been used for like parts as appropriate. However, the single main frame strut 12 of FIG. 21 is replaced with a pair of parallel struts 72 forming the base frame of the machine. The single guide rail 38 is thus replaced by two guide rails 74, one on each of the base struts 72 aligned with and facing the respective rail 40 on the undersurface of struts 22. A pair of wedge shaped plates 75 identical in shape to the wedge plates 44 of FIGS. 21 to 24 are provided at each end of the system 70, with the two pairs of plates connected by an upper connecting rod 76 and a pair of lower connecting rods 77. A roller or wheel 78 is rotatably mounted at each end of the upper rod 76 between the respective pairs of wedge plates, in moving engagement with the respective guide rail 40. A roller or wheel 79 is also rotatably mounted at each end of each of the lower rods 77, between the respective pairs of wedge plates, with the wheels 79 at each end movably engaged with the respective guide rods.

The wheels in the wedge lifting systems of FIGS. 21 to 25 have concave rims which run over a cylindrical rod or convex rail surface. However, it will be understood that there are several possible alternative designs for mating of the wheel and the rail, as described in my copending application filed on Jun. 12, 2002 and entitled "Composite Motion Exercise Machine". Thus, the wheels may have convex rims and run on concave or indented grooves on the rails. Alternatively, the wheel may have a flat rim with a radius or chamfered edge, and may run over a flat rail with raised edges to match the radius in the wheel. The wheel may have a groove for running over a ridged surface on the mating rail. This would help to keep the wheel in place on the rail. Alternatively, the wheels could each be captured in a channel or between two rails.

FIG. 1 illustrates the machine with the exercise arm 14 in the starting or fully retracted position. In this position, the wedge linking or lifting system 18 (or system 70) is located at the rear ends of the guide rails 38 and 40. Suitable end stops, such as end stop 80 illustrated in FIGS. 1 and 2, may be provided at the ends of the rails 38 and 40 to prevent the wheels from traveling off the rail ends. In order to perform the exercise, the user reclines on the back pad 26 with their shoulders against the shoulder pads 28, placing their feet against the foot plate 20. They then push the foot plate forwards, forcing the exercise arm 14 to rotate about pivot axis 15. At the same time, the connecting linkage or cables 55 which connect the exercise arm to the wedge plates 44 will pull the wedge assembly along the slide rails 38 and 40 towards pivot axis 15, so that the user support 16 is urged upwardly, as indicated in FIG. 2, forcing the support to pivot about pivot axis 15. The load, supplied by weight plates (not illustrated) added to the weight pegs 60, travels with the user support to provide a resistive force to movement of the exercise arm.

The user support pad 26 is at an angle of 8 degrees to the horizontal in the starting position of FIG. 1, and moves to an orientation of 29 degrees (i.e. through an angle of 21 degrees) into the fully extended position of FIG. 2. At the same time, the exercise arm moves from an angle of 55 degrees to the horizontal in FIG. 1, to an angle of 125 degrees in the fully extended position of FIG. 2 (i.e. moving through an overall angular distance of 70 degrees). Thus, with the pivotal linkage of FIGS. 1 and 2, while the exercise arm and the user support travel in the same direction during an exercise movement, they do so at different rates and grow further apart during the movement.

The use of the wedge lifting or linkage system between the main frame, user support, and exercise arm will reduce the overall cost of the assembly over prior art arrangements which required pivotal connections. The embodiment of FIGS. 1 and 2 uses wheels rather than linear bearings, which do not require the hardened shafting needed for a linear bearing. The shafts between the wedge plates do not have to be lubricated and require less maintenance than the shafting used for linear bearings.

Figure 4:
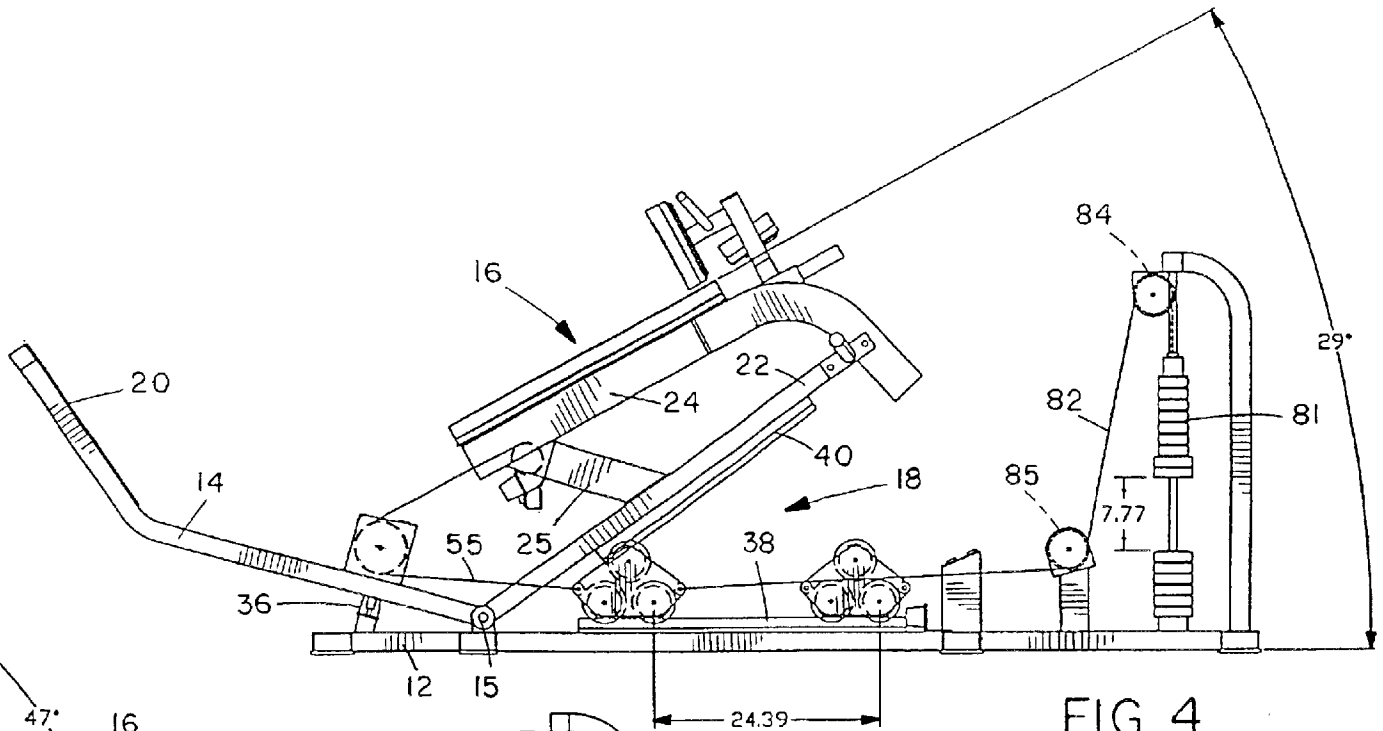
FIG. 4 is a side elevational view of the machine of FIG. 3, illustrating the fully extended position.
Figure 3:
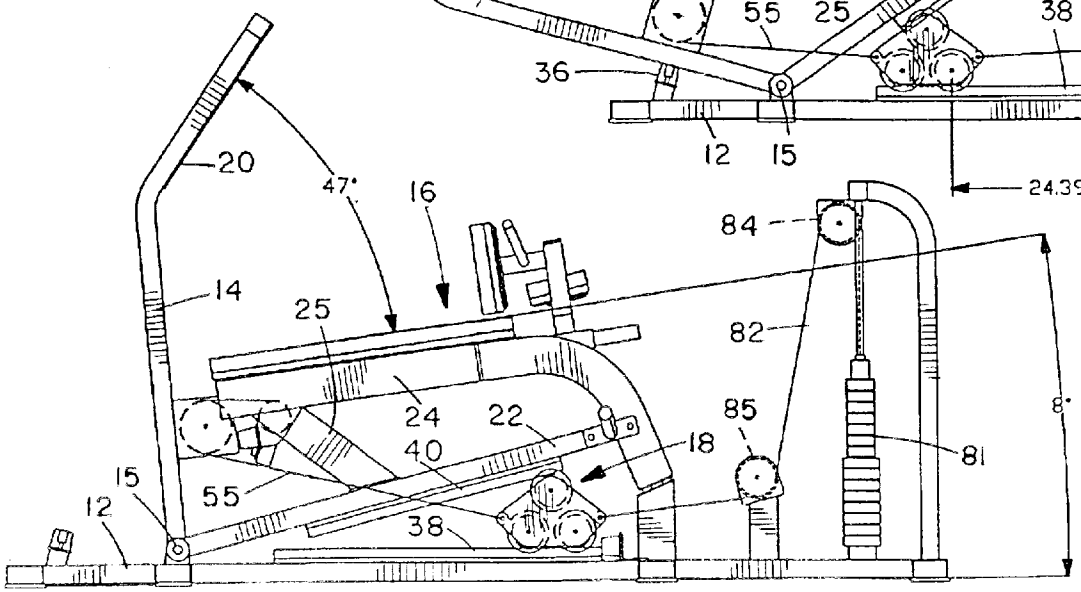
FIG. 3 is a side elevational view of a composite motion machine according to a second embodiment of the invention, showing the machine in a starting exercise position.

In the embodiment of FIGS. 1 and 2, load is provided by the weight of the user as well as the weight of the user support, augmented by weight plates placed on the pins 30 on the user support. However, the additional load or exercise resistance may be provided in many different ways, as will be understood by those skilled in the field, such as weight plates, a weight stack, air or hydraulic resistance, electric or magnetic resistance, tension springs, bands or rods, or any other form of exercise resistance common in the field. The additional resistance may be connected to any of the moving parts, such as the exercise arm, the user support, or the movable wedge linkage system. FIGS. 3 and 4 illustrate a modification of the leg press machine of FIGS. 1 and 2 with a different type of additional resistance. The machine of FIGS. 3 and 4 is otherwise identical to that of FIGS. 1 and 2, and like reference numerals have been used for like parts as appropriate.

Figures 5, 6:
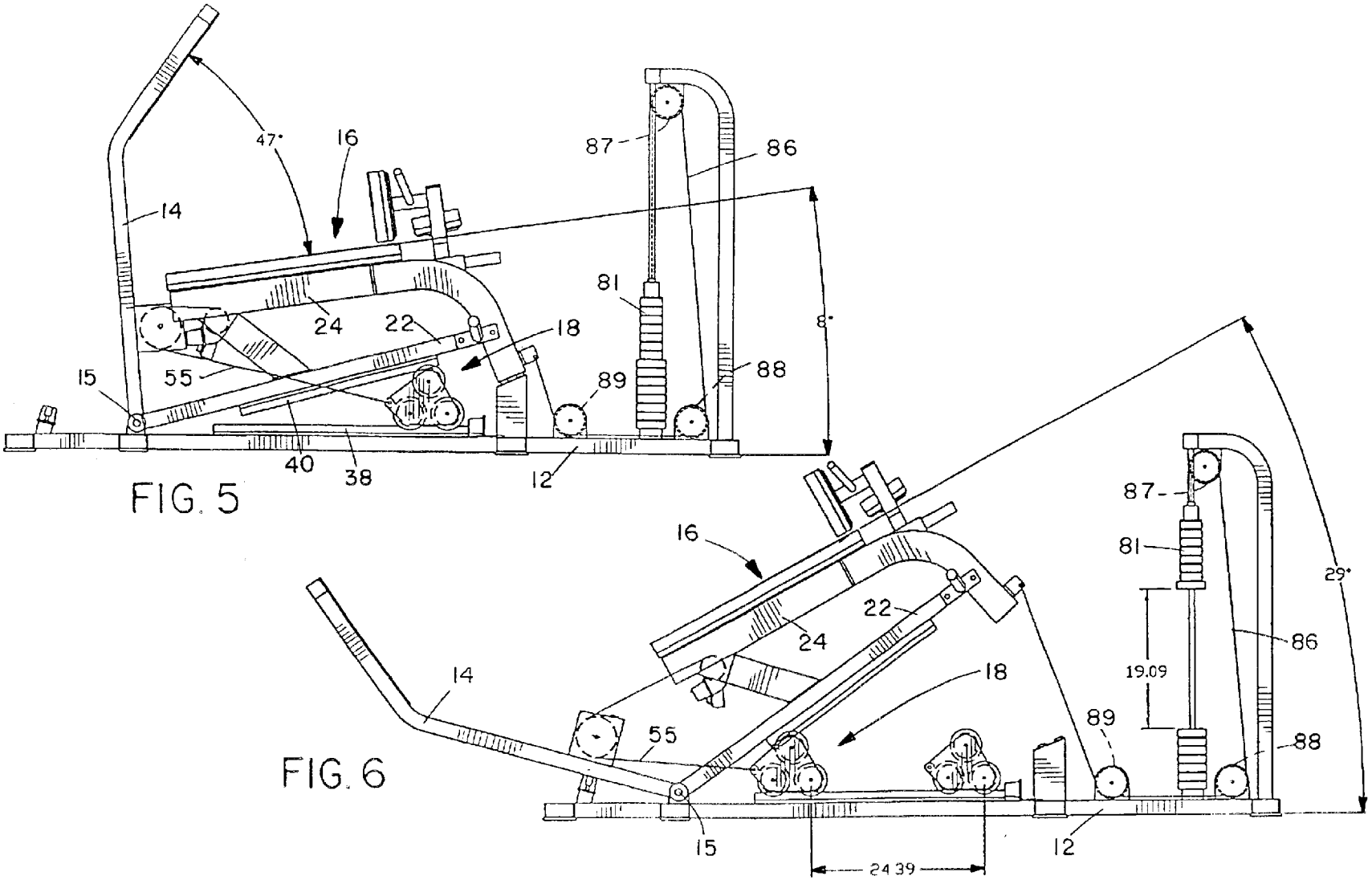
FIG. 5 is a side elevational view of the starting position of a composite motion machine similar to that of FIGS. 3 and 4, but with a different attachment location for the load.
FIG. 6 is a side elevational view of the machine of FIG. 5, illustrating the fully extended position.

In the machine of FIGS. 3 and 4, a weight stack 81 is linked to the user support, either in place of or in addition to weight plates on pegs 30, so as to provide additional resistance. Cable or belt 82 is attached to the weight stack at the rear end of the frame, and runs around pulleys 84 and 85 to connect to the rear end of the wedge plates 44. FIGS. 5 and 6 illustrate a modification in which the weight stack 81 is attached to the user support 16 instead of the wedge system 18. In this alternative, cable 86 extends from the weight stack 81 around pulleys 87, 88 and 89 before connecting to the rear end of the upper support 24 of the user support. The arrangement of FIGS. 5 and 6 produces greater weight stack travel, as can be seen from a comparison of FIGS. 4 and 6, and thus it generates more resistance. The amount of required resistance can vary based on the type of exercise being performed. Weaker muscle groups, which use less resistance, could be better suited for the weight stack set up of FIGS. 3 and 4, while stronger muscle groups would benefit from the increased resistance of FIGS. 5 and 6.

Figure 8:
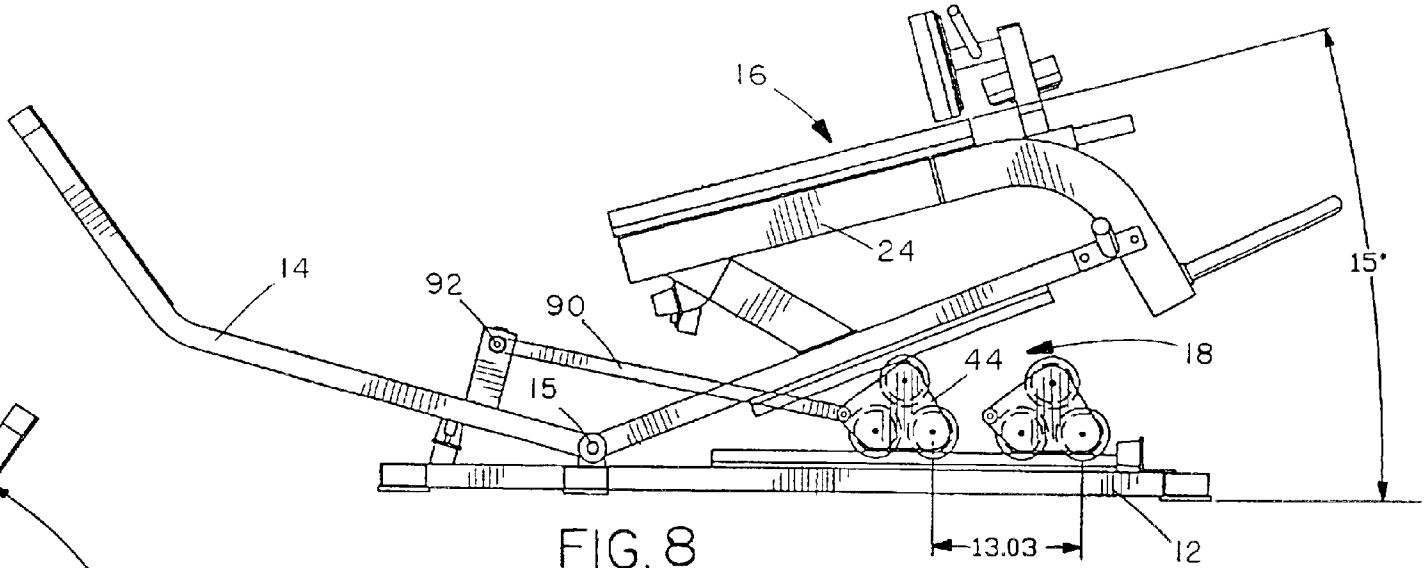
FIG. 8 is a side elevational view of the machine of FIG. 7, illustrating the fully extended position.
Figure 7:
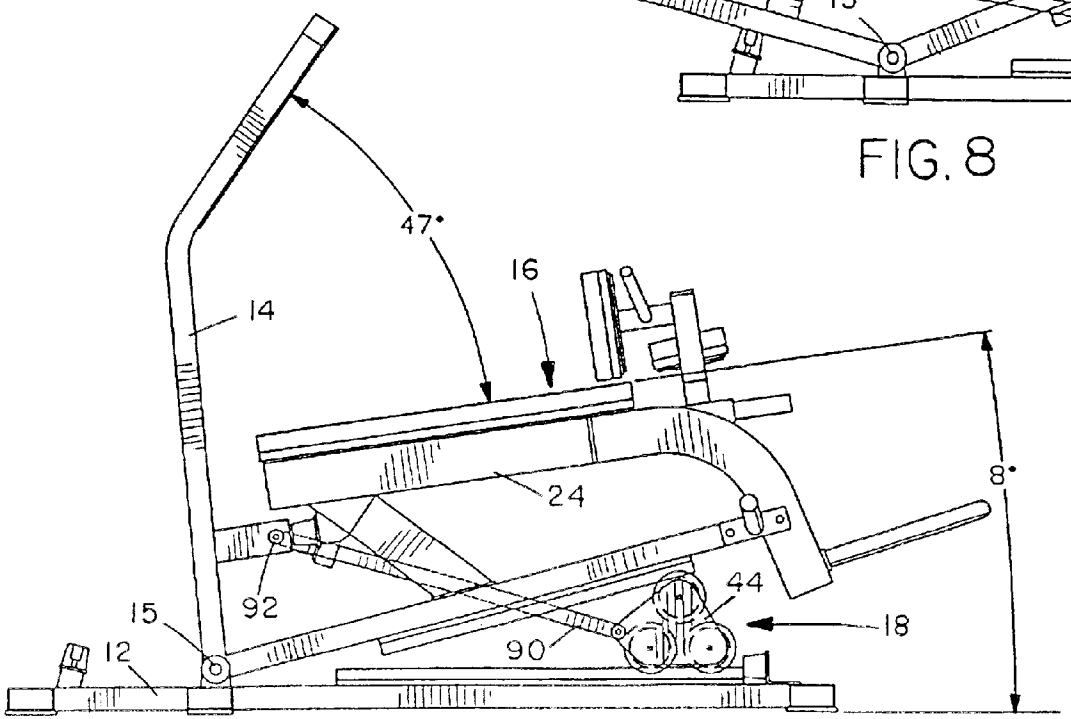
FIG. 7 is a side elevational view of a composite motion machine according to a third embodiment of the invention, showing the machine in a starting exercise position.

FIGS. 7 and 8 illustrate a leg press machine similar to that of FIGS. 1 and 2, but with a modified connecting link between the wedge plates 44 and exercise arm. The machine of FIGS. 7 and 8 is otherwise identical to that of FIGS. 1 and 2, and like reference numerals have been used for like parts as appropriate. In this embodiment, instead of a belt 55 linking wedge plates 44 to the exercise arm 14, a straight link arm 90 connects each wedge plate 44 to the exercise arm 14. Arm 90 is pivoted at one end to the wedge plate 44, and is pivotally connected to the arm 14 at pivot 92. The straight link arm 90 performs exactly the same function as the cable 55 of the first embodiment. However, the amount of movement of both the user support 16 and the wedge lifting system 18 is different in this embodiment. As seen in FIGS. 7 and 8, the user support 16 moves through an angle of 7 degrees between the start position and the fully extended position, and the wedge lifting system 18 travels a distance of 13.03 inches, as compared to 24.3 inches in FIGS. 1 and 2. Link arm 90 may be replaced by an adjustable length, telescopic link arm in an alternative embodiment. The link arm length may be adjusted in order to vary the starting orientation of the exercise arm 14 relative to the user support 16.

Figure 10:
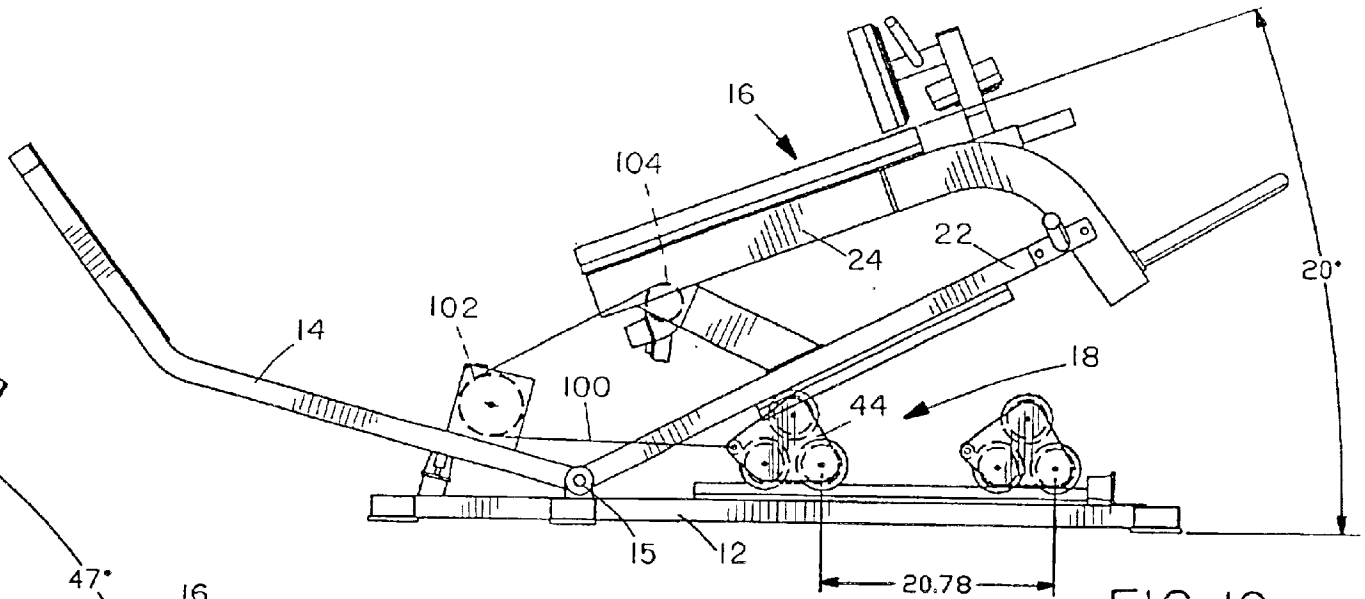
FIG. 10 is a side elevational view of the machine of FIG. 9, illustrating the fully extended position.
Figure 9:
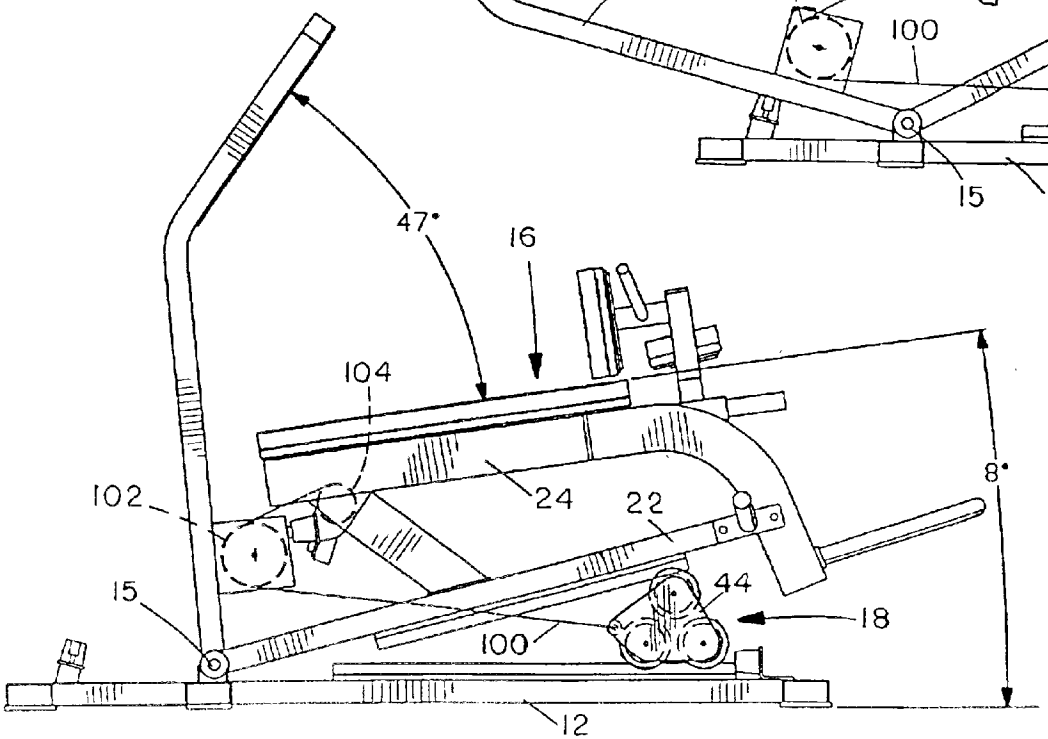
FIG. 9 is a side elevational view of a composite motion machine with a different pulley placement, according to fourth embodiment of the invention, showing the machine in-a starting exercise position.

FIGS. 9 and 10 illustrates another modification of the leg press machine of FIGS. 1 and 2 in which a different pulley placement results in variation in the travel distance of the wedge system and a different travel ratio between the exercise arm and the user support. This embodiment is otherwise identical to that of FIGS. 1 and 2, and like reference numerals have been used for like parts as appropriate.

In FIGS. 9 and 10, a belt 100 extends from the wedge 44, around a pulley 102 on the exercise arm 14, and then terminates at a tie off 104 at the forward end of the user support 16. In this embodiment, the pulley 102 on the exercise arm is mounted at a lower position than the pulley 58 of FIGS. 1 and 2. This decreases the travel of the wedge 44 and reduces the amount of resistance felt by the user. As illustrated in FIGS. 9 and 10, the user support travels through a smaller angle between the start and fully extended position than in FIGS. 1 and 2, reducing the exercise resistance.

Figure 12:
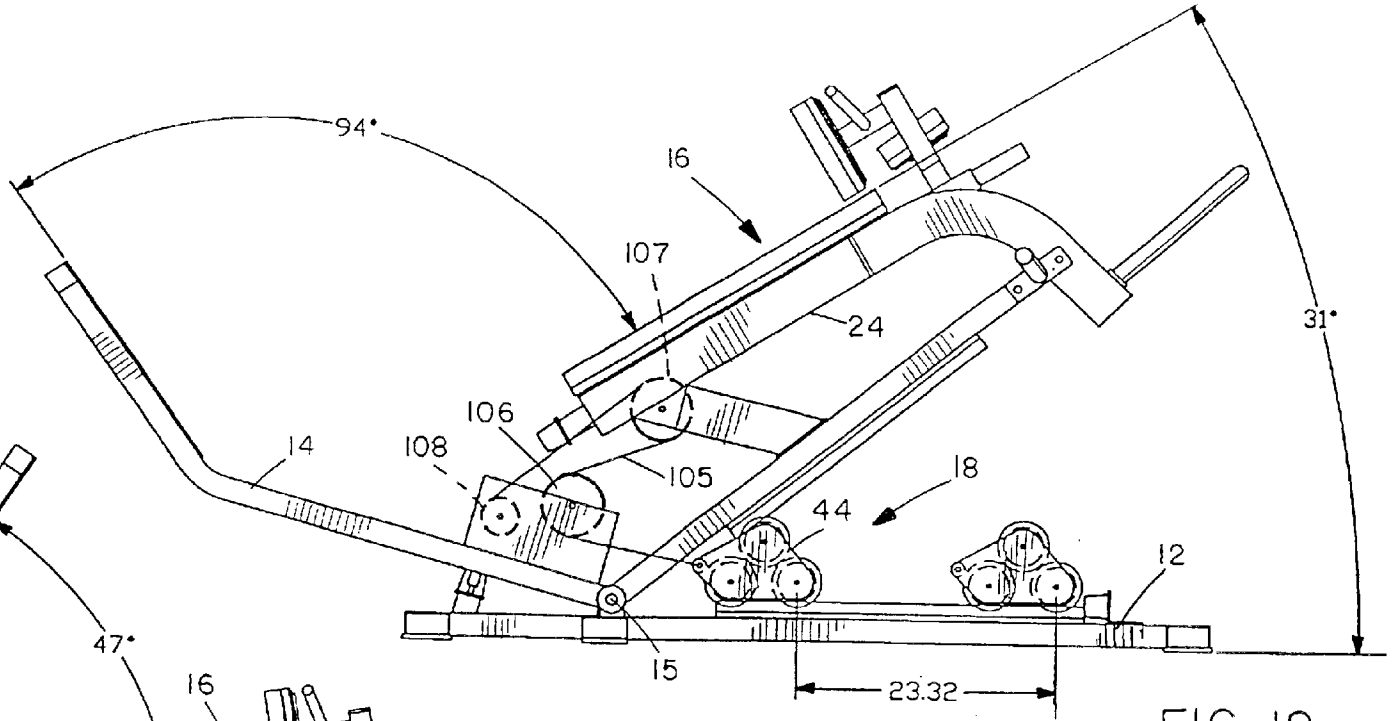
FIG. 12 is a side elevational view of the machine of FIG. 11, illustrating the fully extended position.
Figure 11:
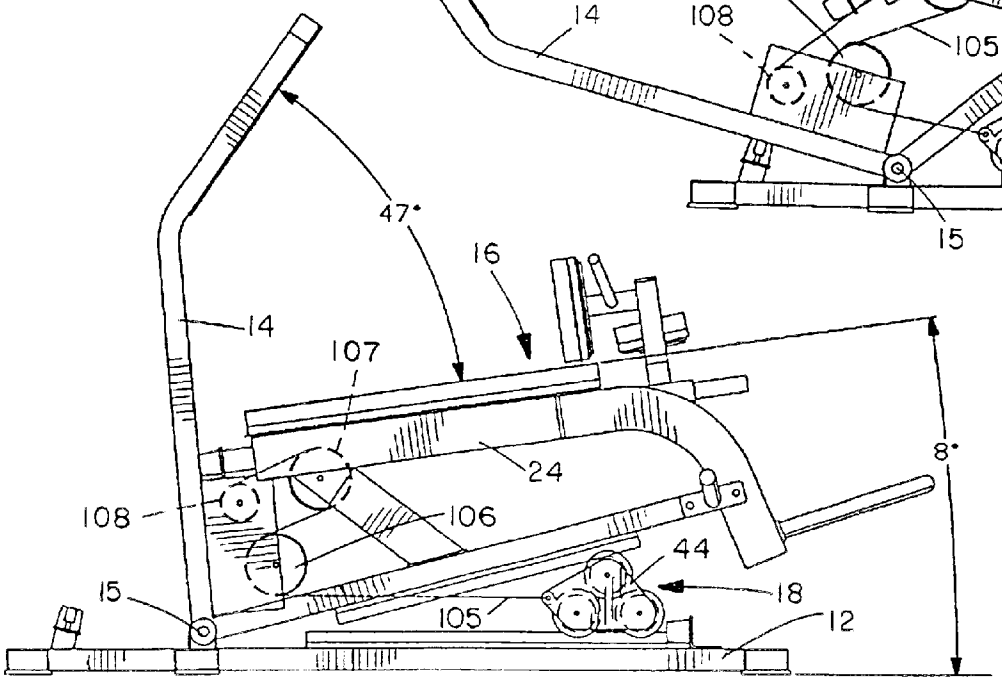
FIG. 11 is a side elevational view of a composite motion machine with another modified pulley arrangement, according to a fifth embodiment of the invention, showing the machine in a starting exercise position.

FIGS. 11 and 12 illustrate another modified linkage with a different linkage between the wedge plate 44, exercise arm 14, and user support 16. The machine is otherwise identical to that of FIGS. 1 and 2, and like reference numerals have been used for like parts as appropriate. In this embodiment, a cable or belt 105 extends from wedge 44 around a first pulley 106 on the exercise arm 14, a second pulley 107 on the upper strut 24 of the user support, and back to a tie-off 108 on the exercise arm 14. Thus, in this embodiment, an additional pulley is added on the user support and the belt terminates back on the exercise arm. This increases the travel of the wedge and the user support, and increases the amount of resistance felt by the user.

The embodiments of FIGS. 9 and 10 and 11 and 12 illustrate the versatility of this invention in easily allowing small changes to be made in order to alter the resistance. This is useful when designing machines to work specific body parts that require different resistances based on the strength curves of a particular muscle group.

Figure 14:
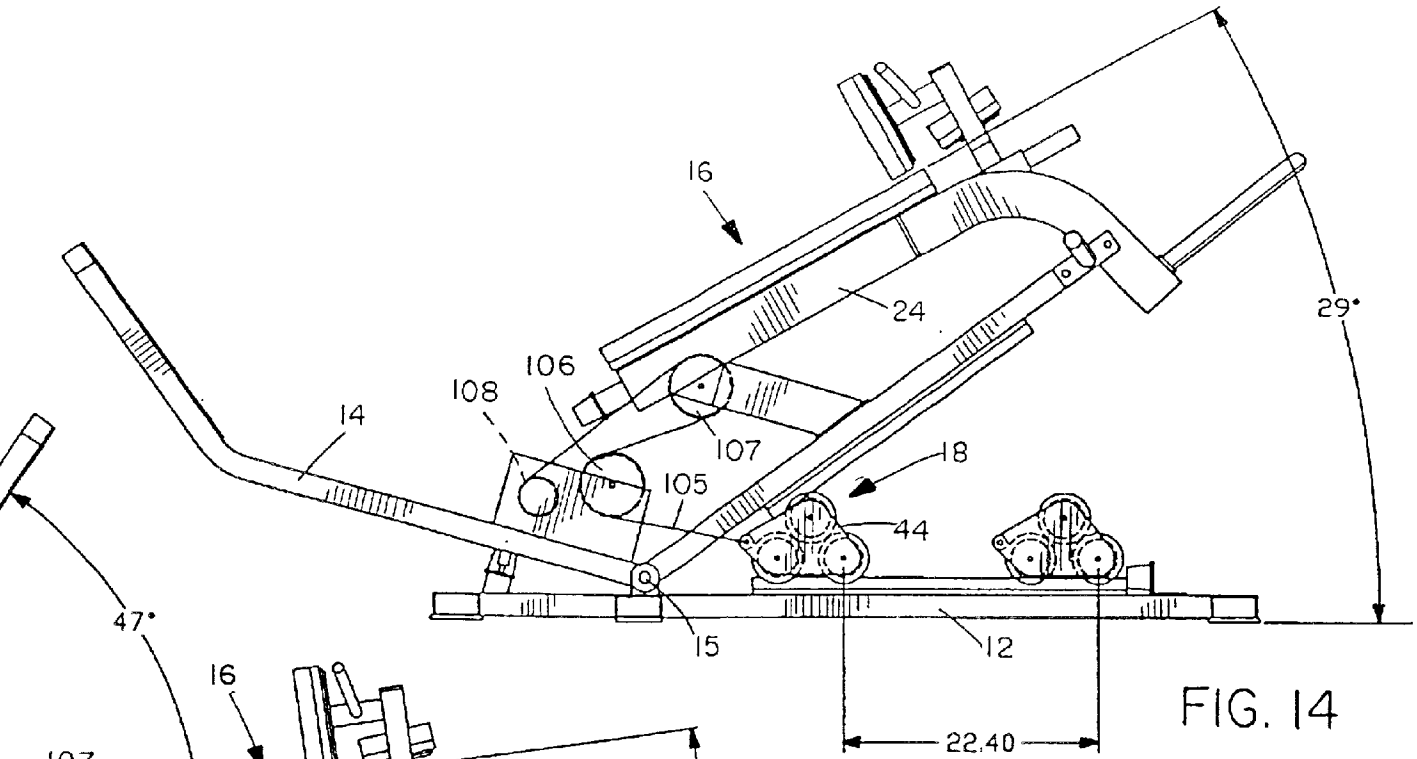
FIG. 14 is a side elevational view of the machine of FIG. 13, illustrating the fully extended position.
Figure 13:
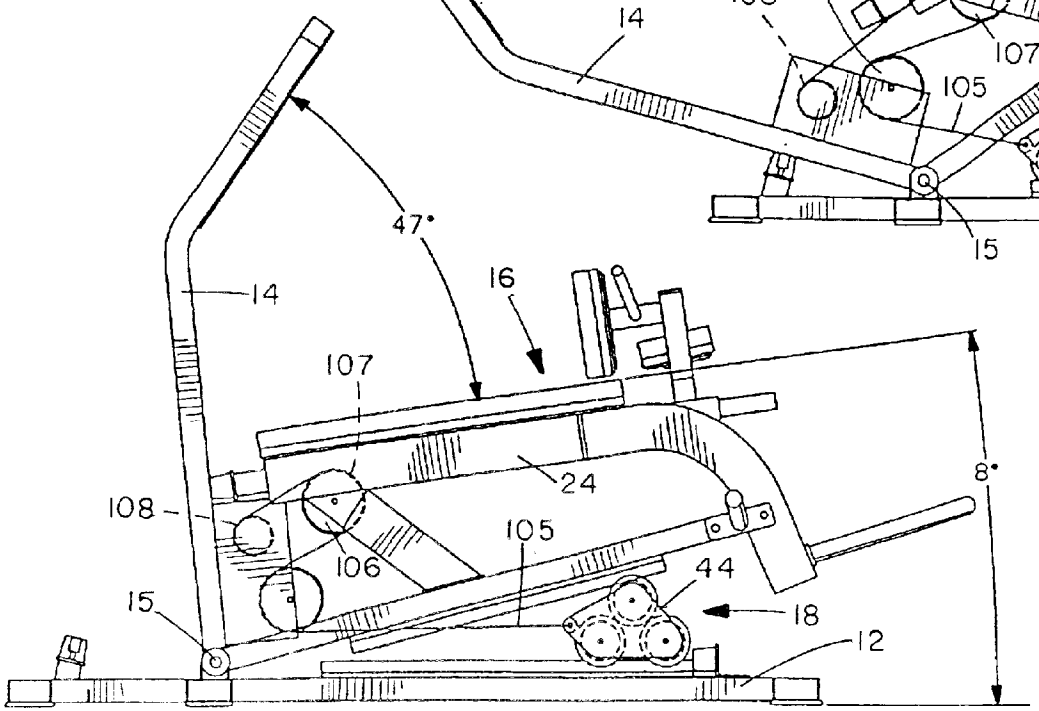
FIG. 13 is a side elevational view of a composite motion machine similar to that of FIGS. 11 and 12, but with a modified pulley and belt arrangement producing a different travel ratio, with the machine in a starting exercise position.

FIGS. 13 and 14 illustrate the machine of FIGS. 11 and 12 with a minor adjustment in the position of the pulley 106 on the exercise arm, so as to produce exactly the same travel ratios as the machine of FIGS. 1 and 2. The machine in FIGS. 13 and 14 is otherwise identical to that of FIGS. 11 and 12, and like reference numerals have been used for like parts as appropriate.

Figure 16:
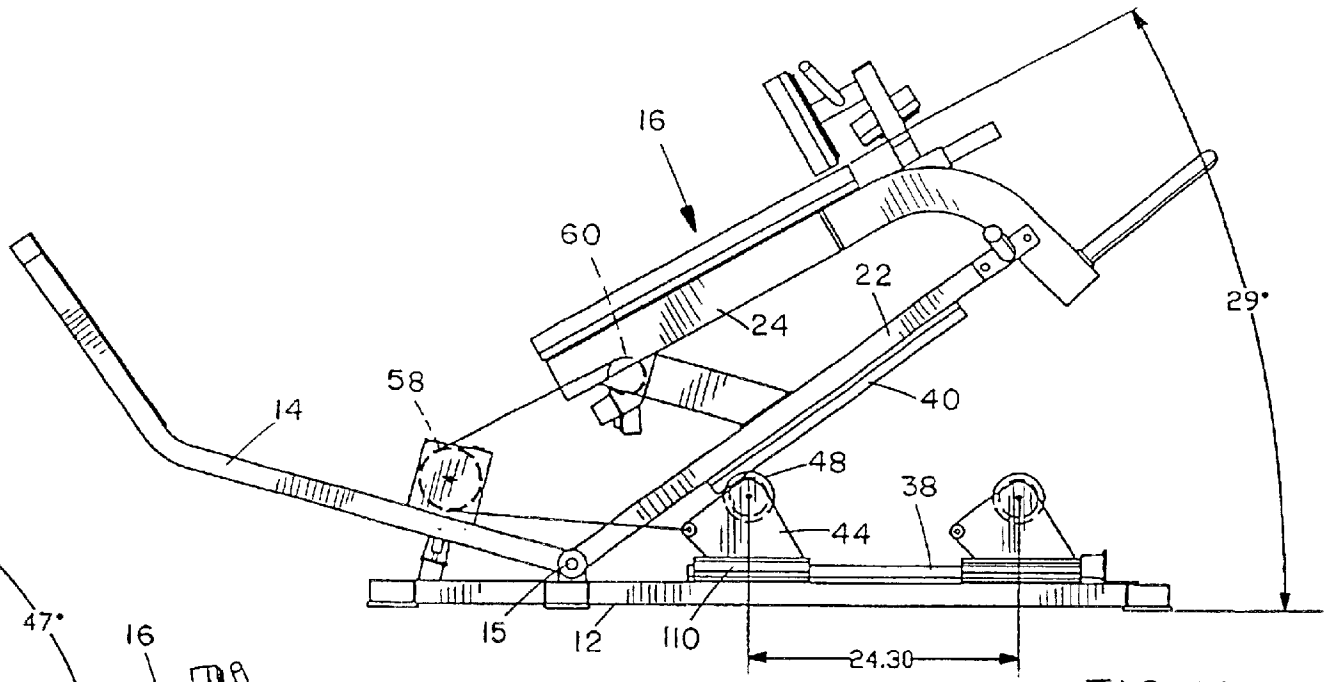
FIG. 16 is a side elevational view of the machine of FIG. 15, illustrating the fully extended position.
Figure 15:
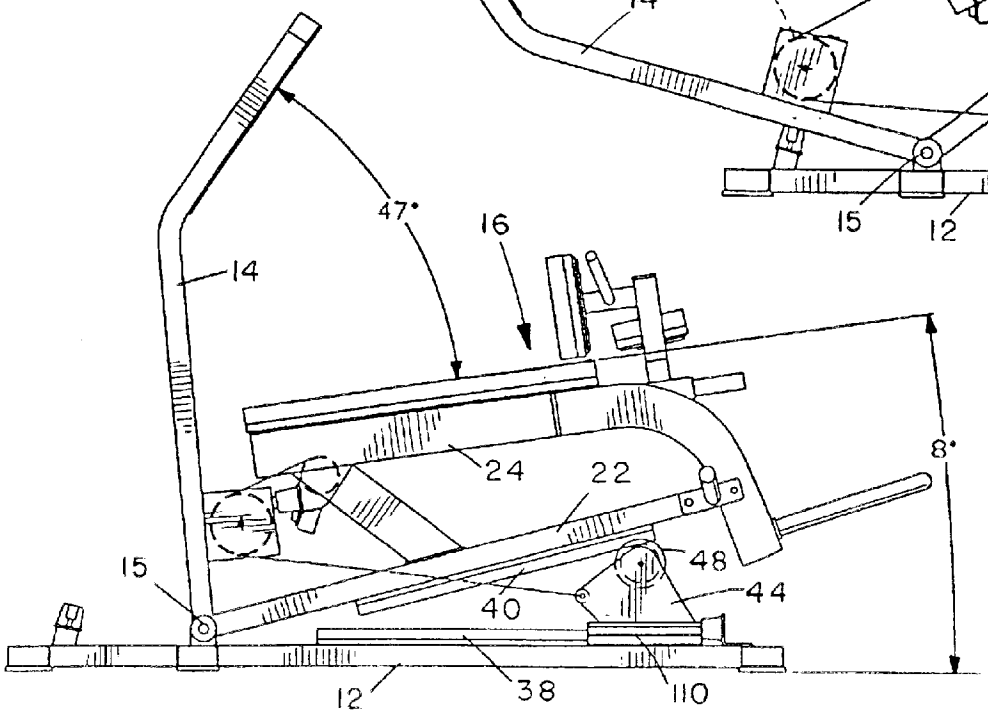
FIG. 15 is a side elevational view of a composite motion machine with a modified wedge lifting system, according to another embodiment of the invention, showing the machine in a starting exercise position.

In the embodiment of FIGS. 15 and 16, the lower wheels 54 of the wedge lifting system of FIGS. 1, 2 and 21 to 24 are replaced by a linear bushing or bearing 110 which engages the slide rail 38 on the main frame. The machine of FIGS. 15 and 16 is otherwise identical to that of FIGS. 1 and 2, and like reference numerals have been used for like parts as appropriate. The wedge lifting system of FIGS. 15 and 16 produces exactly the same travel ratios and resistance as that of FIGS. 1 and 2.

Figure 18:
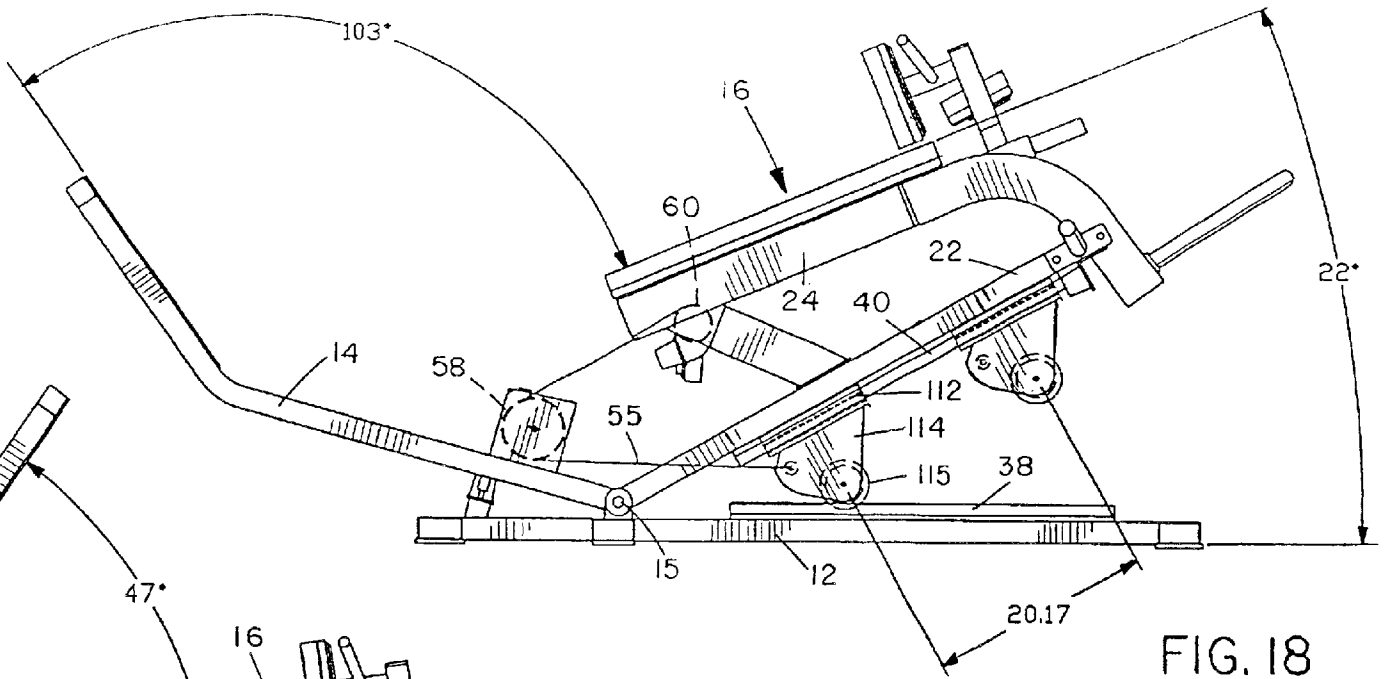
FIG. 18 is a side elevational view of the machine of FIG. 17, illustrating the fully extended position.
Figure 17:
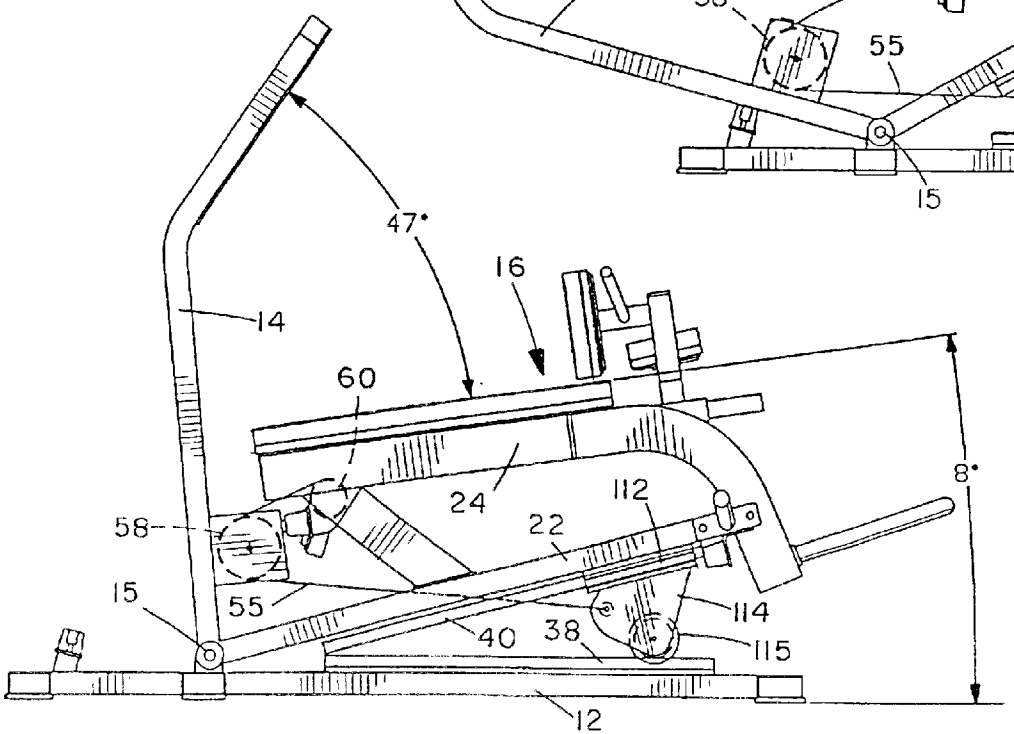
FIG. 17 is a side elevational view illustrating a modification of the composite motion machine of the previous embodiment, with the machine in a starting exercise position.

FIGS. 17 and 18 illustrate another variation in the wedge lifting system in which the upper wheels 50 of FIGS. 1, 2 and 21 are each replaced with a linear bushing or bearing 112 which slidably engages the respective rails 40. At the same time, wedge plates 114 of slightly modified shape are provided to replace the plates 44 of FIG. 21, with only one wheel 115 engaging the lower rail 38, in place of the two wheels 54 positioned in line as in FIG. 21. The travel ratios produced in this alternative embodiment are different from those of FIGS. 1 and 2 and 15 and 16, with the overall travel of the wedge system being reduced from 24.30 inches to 20.17 inches, and the angular travel of the user support changing from 21 degrees to 14 degrees. Thus, the resistance felt by the user will be reduced.

Figure 19:
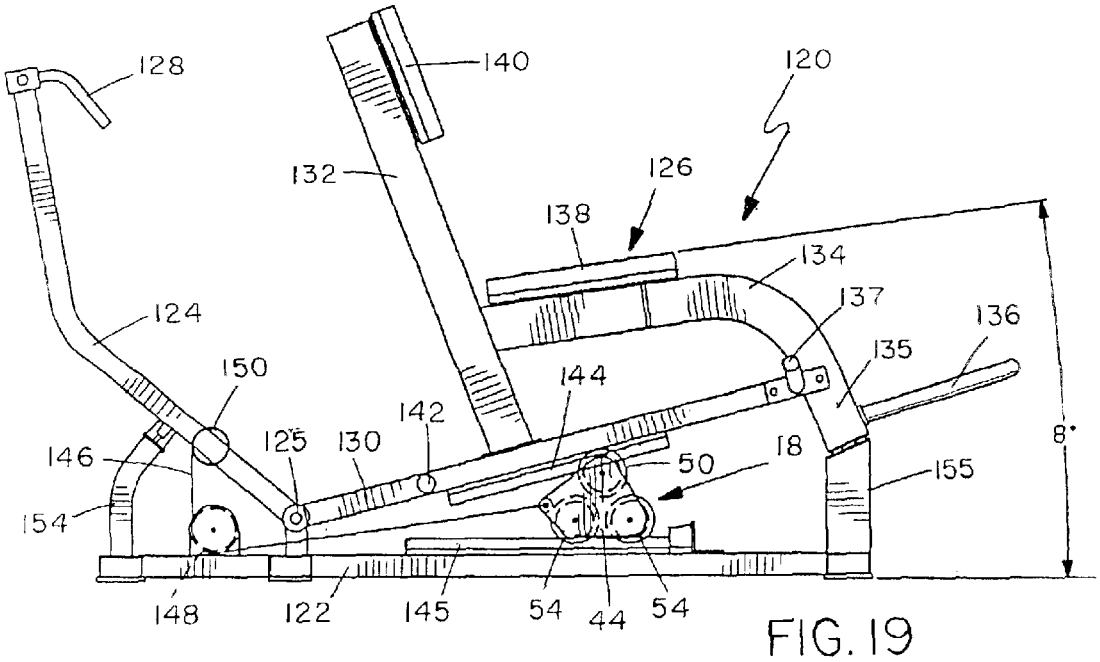
FIG. 19 is a side elevational view of an upper body composite motion machine according to another embodiment of the invention, showing the machine in a starting exercise position.
Figure 20:
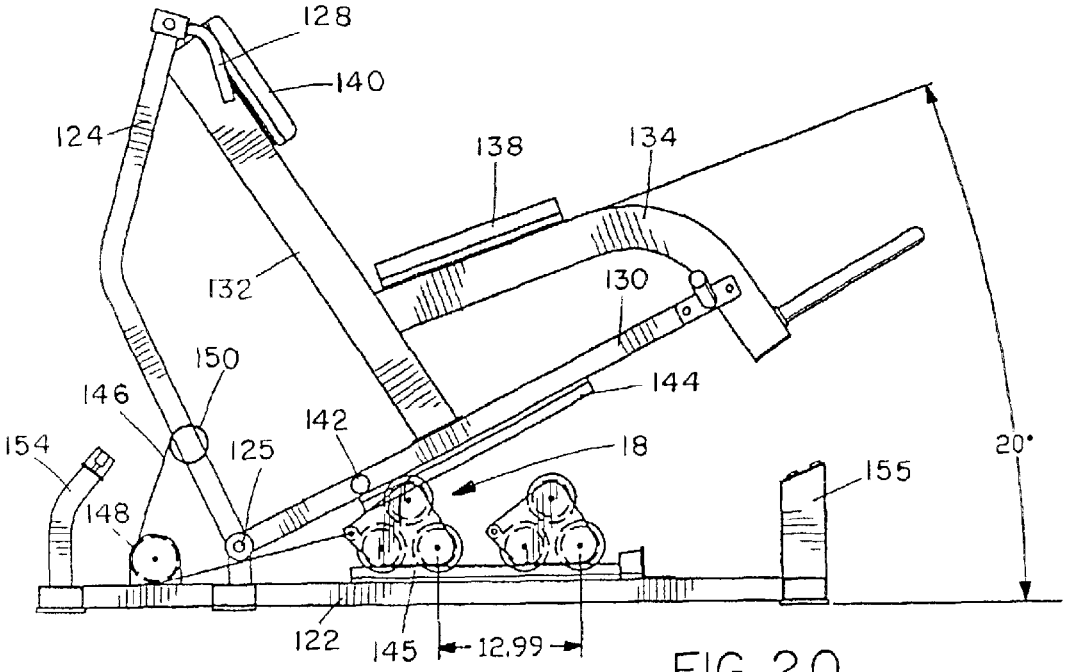
FIG. 20 is a side elevational view of the machine of FIG. 19, illustrating the fully extended position.

FIGS. 19 and 20 illustrate an upper body exercise machine 120 according to another embodiment of the invention. The machine has a main frame 122, an exercise arm 124 pivotally attached to the main frame at its lower end for rotation about pivot axis 125, and a user support 126 which is also pivotally attached to the main frame to rotate on a pivot shaft collinear with pivot axis 125. A moving wedge lifting system 18 identical to that of FIGS. 21 to 24 is provided between the user support, main frame and exercise arm, as will be described in more detail below. Since the system 18 is identical to that of FIGS. 21 to 24, like reference numerals have been used for like parts, as appropriate.

In this embodiment, the exercise arm 124 has handles 128 at its upper end for gripping by a user when performing exercise. The user support comprises a base strut 130 extending rearwardly from pivot 125, a generally upright strut 132 extending upwardly from base strut 130 at a location spaced between its ends, and a seat support strut 134 extending forward from upright strut 132 at a location spaced above the base strut 130. Seat support strut 134 has a downwardly directed, rear portion 135 having a weight plate support peg 136 adjacent its lower end, and additional weight plate support pegs 137 are provided on the rear end of base strut 130. The base strut 130 is secured to the downwardly directed portion 135 at its rear end. The seat support strut 134 has a seat pad 138 for the user to sit on, and the upright strut 132 has a chest support pad 140 adjacent its upper end to hold the user in place and provide bracing for their upper body when performing an exercise. Footrests 142 are mounted on the base support strut 130 to provide added comfort to the user when performing exercise.

A first rail 145 is mounted on the main frame 122 and the lower wheels 54 of the wedge lifting system 18 travel back and forth on rail 145. A second rail 144 is mounted on each base support strut 130 facing rail 145, and the upper wheels 50 engage rails 144 in an equivalent manner to the embodiment illustrated in FIGS. 21 to 24. A connecting belt 146 extends from wedge plate 44 around a pulley 148 on the frame 122 and terminating at a tie off 150 on the exercise arm 124 at its second end. Front and rear support posts 154, 155 on the main frame 122 support the exercise arm 124 and the user support 126, respectively, when in the starting position of FIG. 19.

In order to perform the exercise, a user sits on the seat pad 138 with their feet on footrests 142, facing forward, and grabs the handgrips 128, with the machine in the starting position of FIG. 19. They then pull the exercise arm 124 towards them. As the exercise arm rotates in a clockwise direction about its pivot 125, the belt 146 will pull the wedge plate 44 forwards along the two rails This will raise the user support 126, forcing the base strut 130 to rotate in an anti-clockwise direction about its pivotal connection 125 to the frame. The load, supplied by weight plates added to the weight pegs 136, 137, travels with the user support to provide a resistive force to movement of the exercise arm, in addition to the weight of the user and the user support itself. In this embodiment of the invention, the exercise arm and user support travel in different directions towards one another and grow closer together during the exercise movement.

FIGS. 19 and 20 depict the movement relationship between the exercise arm, user support, and movable wedge from the start to the finish of an exercise movement. As illustrated, the wedge 44 moves only a short distance along the rails as the exercise arm and user support move from the start to the finish position. The user support travels through an angle of around 12 degrees from the start to the finish position, while the exercise arm travels through an angle of around 25 degrees.

Figure 27:
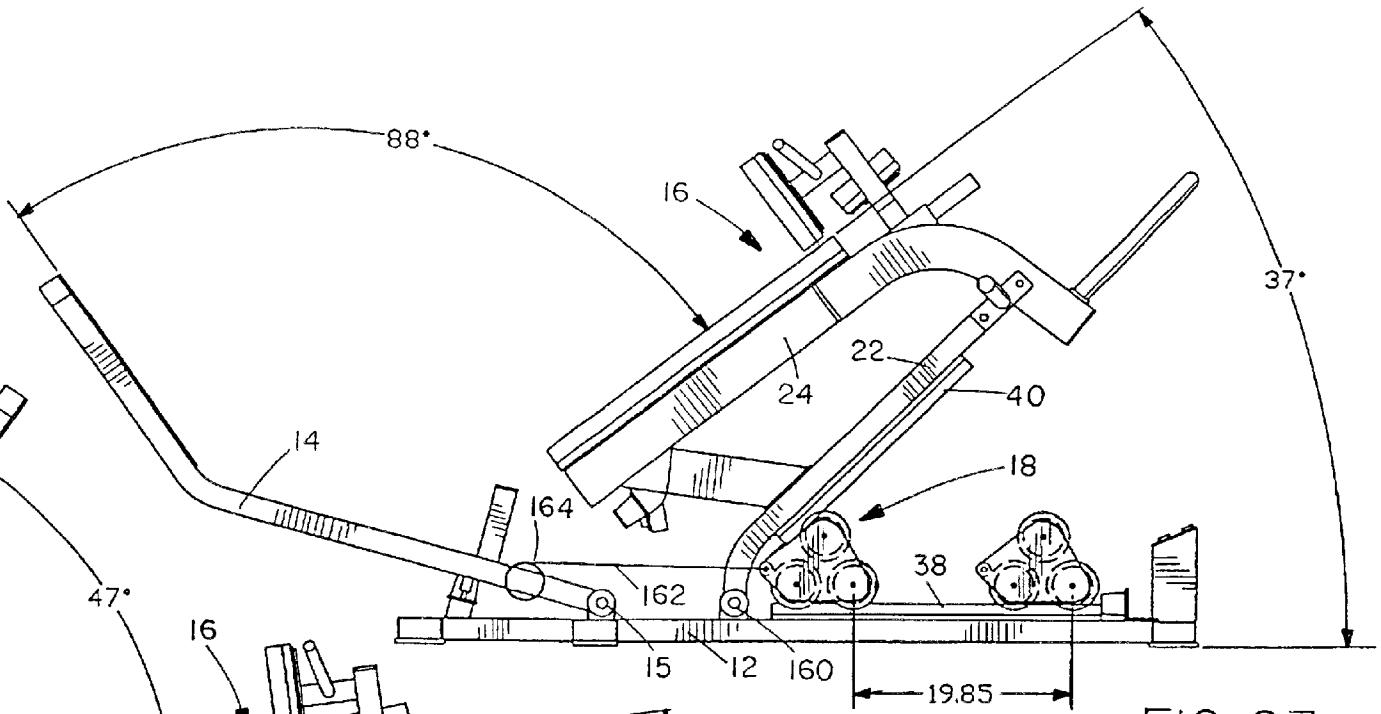
FIG. 27 is a side elevational view of the machine of FIG. 26, illustrating the fully extended position.
Figure 26:
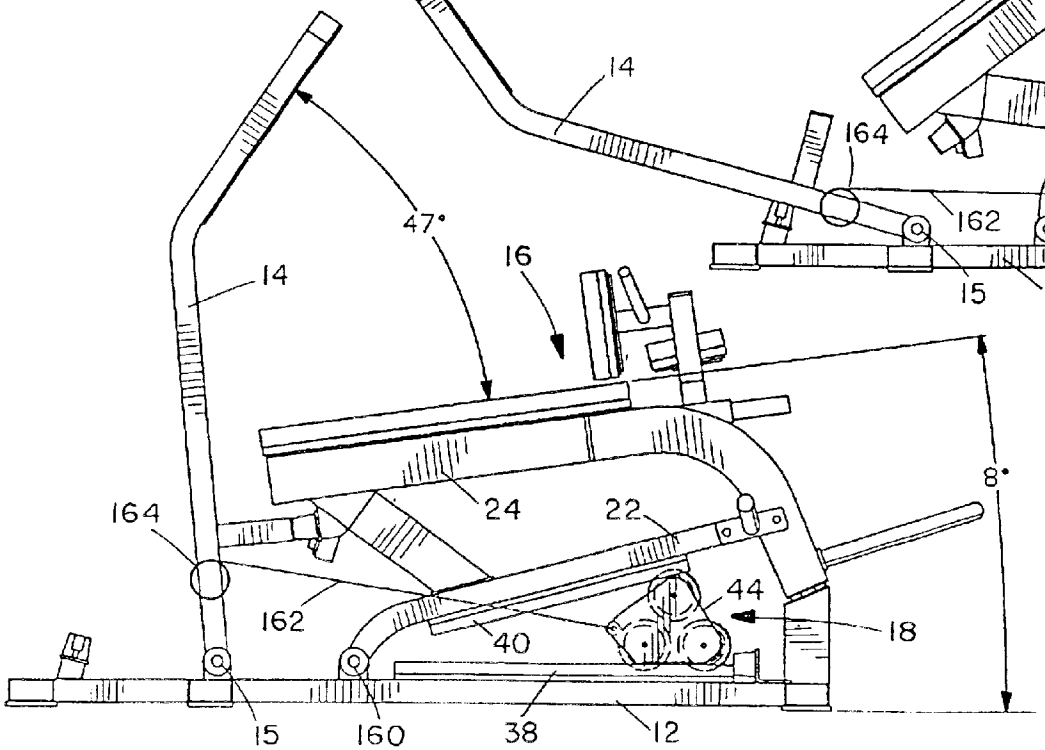
FIG. 26 is a side elevational view of a composite motion machine according to another embodiment of the invention, showing the machine in a starting exercise position.

FIGS. 26 and 27 illustrate another modification of the leg press machine of FIGS. 1 and 2. In this embodiment, unlike the embodiments of FIGS. 1 to 20, the user support and exercise arm do not pivot about a common axis or co-linear axes. Additionally, the connection between the moving wedge and exercise arm is modified. However, the components of the machine of FIGS. 26 and 27 are otherwise identical to those of FIGS. 1 and 2, and like reference numerals are used for like parts as appropriate.

As in the first embodiment, the exercise arm 14 of FIGS. 26 and 27 pivots on the frame 12 about pivot axis 15. However, the lower strut or struts 22 of the user support are pivotally connected to the frame at pivot axis 160, spaced rearwardly from the exercise arm pivot axis 15. The wedge plates 44 are linked to directly to the exercise arm 14 in this embodiment, via a belt 162 which extends from the forward end of wedge plate 44 to a tie off 164 on the exercise arm.

In this arrangement, the user support 16 pivots through an angle of 29 degrees between the start position of FIG. 26 and the fully extended position of FIG. 27, while the exercise arm pivots through an angle of 70 degrees. At the same time, the wedge plate travels along the lower slide rail 38 through a distance of 19.85 inches, i.e. a shorter distance than in FIGS. 1 and 2.

Figure 29:
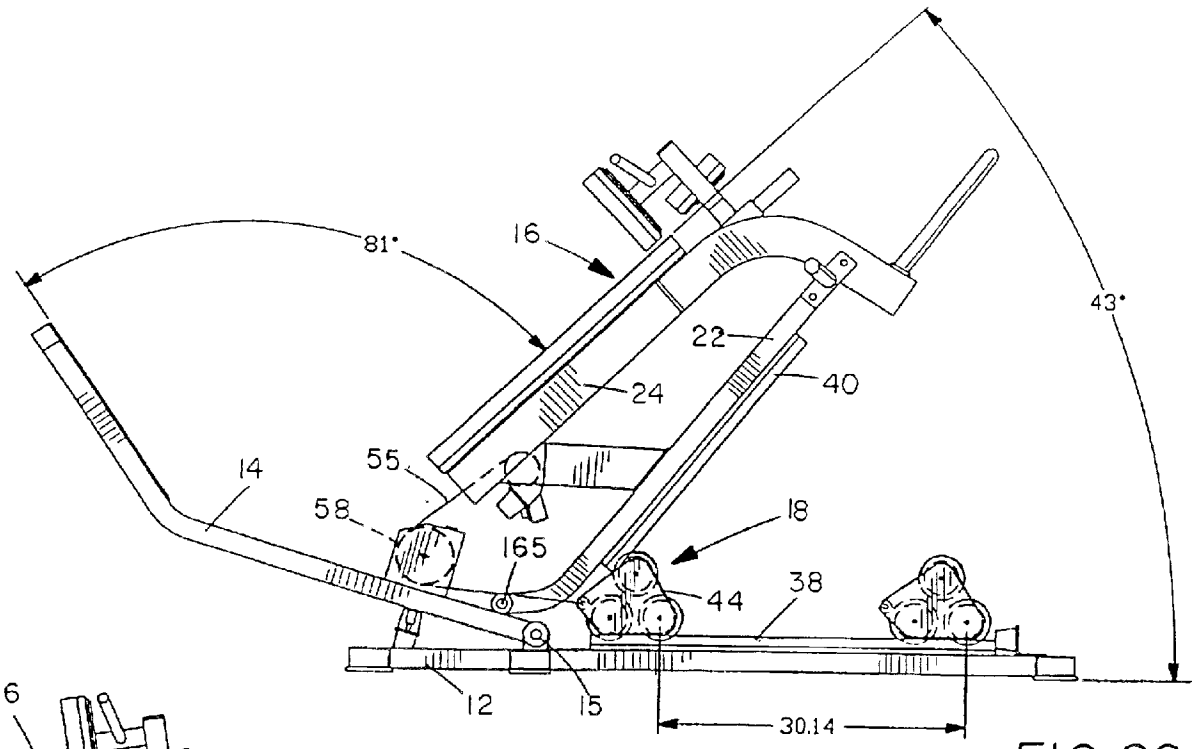
FIG. 29 is a side elevational view of the machine of FIG. 28, illustrating the fully extended position.
Figure 28:
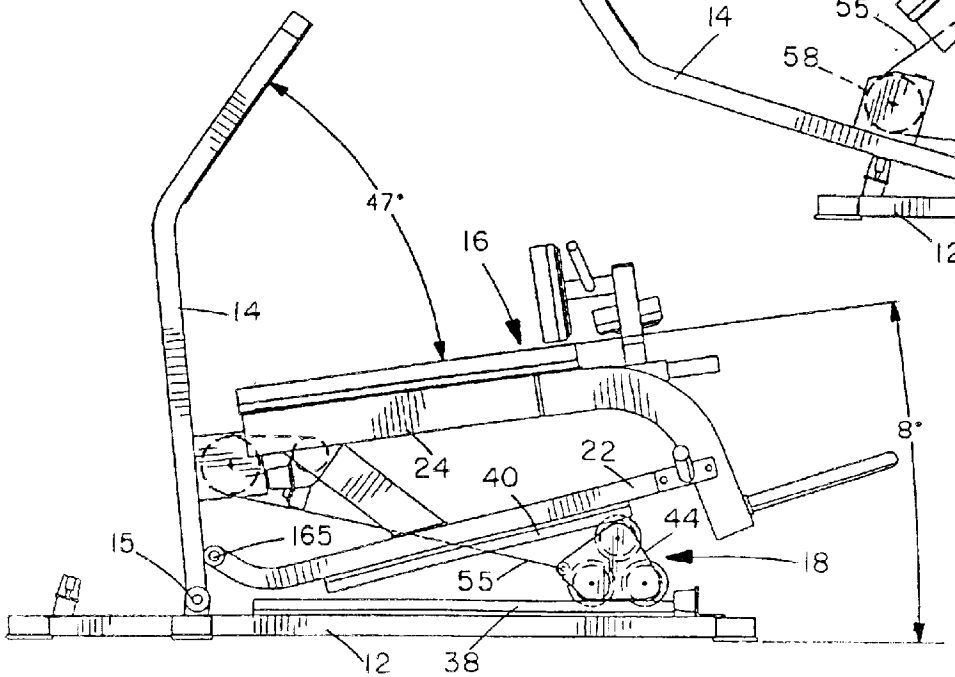
FIG. 28 is a side elevational view of a composite motion machine according to another embodiment of the invention, showing the machine in a starting exercise position.

FIGS. 28 and 29 illustrate another modified pivot arrangement for the user support 16. This embodiment illustrates a connecting link from the moving wedge 44 which is similar to that of FIGS. 1 and 2, and like reference numerals have been used for like parts as appropriate. In this embodiment, as in the previous embodiment and that of FIGS. 1 and 2, the exercise arm 14 pivots on the frame at its lower end via pivot 15. However, rather than pivoting about the same pivot axis as arm 14, the lower bar or struts 22 of the user support are pivoted to the exercise arm 14 at a pivot 165 spaced above pivot 15. This arrangement produces a greater amount of movement of the moving wedge 44 and user support, while the exercise arm moves approximately the same distance. Thus the resistance will be increased.

Figure 30:
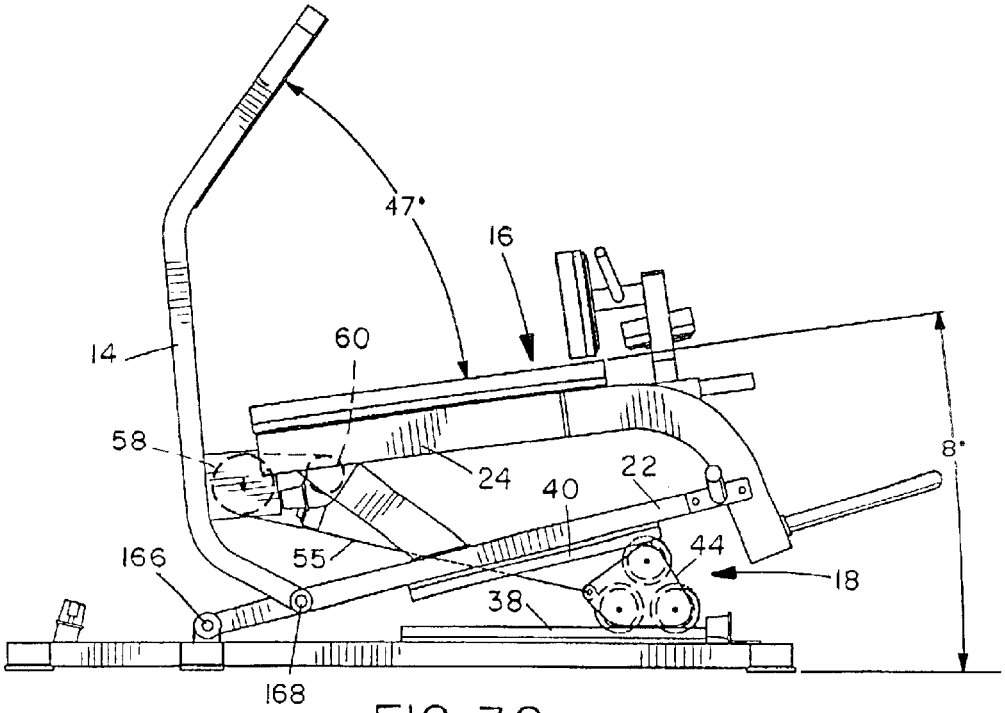
FIG. 30 is a side elevational view of a composite motion machine according to another embodiment of the invention, showing the machine in a starting exercise position.
Figure 31:
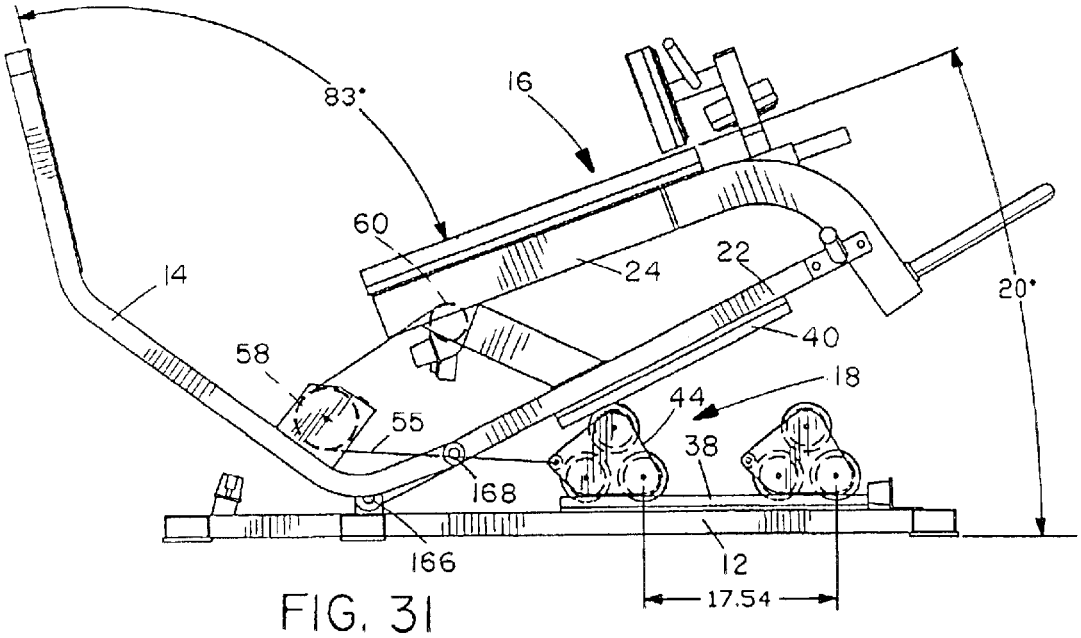
FIG. 31 is a side elevational view of the machine of FIG. 30, illustrating the fully extended position.

FIGS. 30 and 31 illustrate another modified pivoting arrangement, which is the reverse of the previous embodiment. In this embodiment, the lower bar or struts 22 of the user support pivot directly on the frame 22 for rotation about pivot axis 166, while the exercise arm 14 pivots on the lower bar or struts 22 via pivot 168 which is spaced above the pivot 166. The exercise machine of FIGS. 30 and 31 is otherwise identical to that of FIGS. 1 and 2, and like reference numerals have been used for like parts as appropriate. In this embodiment, the user support moves through an angle of 12 degrees between the start and fully extended positions illustrated in FIGS. 30 and 31, while the exercise arm 14 moves through an angle of 48 degrees. The moving wedge travels a distance of 17.54 inches between the start position of FIG. 30 and the fully extended position of FIG. 31. The resistance felt by the user will therefore be less than in the embodiment of FIGS. 1 and 2.

It will be understood that the different elements used in the foregoing embodiments may be mixed and interchanged with one another in order to modify the exercise resistance and movement ratios between the moving parts of the machine. Any variation or combination in the number and/or type of wheels and mated rails may be used. A linear bearing or slide may be used in place of one or more of the wheels in any of the embodiments of FIGS. 1 to 14 and 19 to 31. Various types of connection means may be used to pull the wedge, as indicated in the foregoing embodiments. The location of, and relationship between, the user support pivot and the exercise arm pivot may vary. The direction of travel of the exercise arm may change, the amount of travel of the user support and exercise arm may vary, and the ratio between the travel of the user support and exercise arm may also vary.

In the illustrated embodiments, the load is connected to the user support or to the moving wedge, and is in the form of weight plates and/or a weight stack. However, it will be understood that other types of load or exercise resistance may be used, such as air or hydraulic resistance, electric or magnetic resistance, tension springs, bands, rods, or any other form of exercise resistance common to the field. Also, the load may be connected to any one of the moving elements, i.e. the user support, wedge, or exercise arm.

The exercise arm which is engaged by the user may have any type of engagement means for engaging different parts of a user's body, depending on the exercise to be performed. In the illustrated embodiments, the engagement means takes the form of a foot plate or handles. However, other engagement means such as straps, rollers, pads, plates, and the like may be used. The exercise arm and/or the engagement means may be adjustable to fit the size of the user, and the engagement means may be fixedly or pivotally attached to the exercise arm. The user support may also be adjustable for proper positioning and may be any type of pad, seat, step or platform common in the field.

The exercise machines of the various alternative embodiments described above all provide movement of an actuating member or exercise arm and a user support in a dependent relationship, providing an exercise movement which blends with the natural movement of the human body, providing a safer, more comfortable exercise. The machine can be designed for various different relationships between the travel of the exercise arm and the travel of the user support, from an exercise arm moving faster and over a longer distance than the user support, to the exercise arm and user support moving in a 1:1 relationship over the same distance and at the same speed, or to a user support which travels farther and faster than the exercise arm, providing resistance in a greater than 1:1 ratio.

In each of the above embodiments, the machine comprises six main elements, specifically a main frame, an exercise arm or actuating member, a user support, a movable wedge, a connection means connecting the exercise arm with the movable wedge, and a load. The main frame, exercise arm, and user support are interconnected via the movable wedge and connection means, with either one or both of the exercise arm and user support being pivotally connected to the main frame, which is a non-moving base supporting the other components. Movement of the exercise arm or actuating member causes the user support to be moved. The arrangement of this invention maintains a more advantageous relationship between the user and their engagement position on the exercise arm throughout the entire exercise movement. The position of the user support adjusts to the changing position of the exercise arm during the exercise movement, providing proper and safer support based on that position. At the same time, a more comfortable, better and more natural exercise feeling is produced, enhancing the user's workout.

Although some exemplary embodiments of the invention have been described above by way of example only, it will be understood by those skilled in the field that modifications may be made to the disclosed embodiments without departing from the scope of the invention, which is defined by the appended claims.

I claim:

1. A composite motion exercise machine, comprising:

a main frame;

a user support pivotally linked to the main frame for rotation about a first pivot axis;

an exercise arm pivotally linked to the main frame;

at least one first rail on the main frame;

at least one second rail on the user support facing the first rail; and a movable wedge assembly having a first travel member in traveling engagement with the first rail and a second travel member in traveling engagement with the second rail; and a connection device linking the movable wedge assembly to the exercise arm;

whereby movement of the exercise arm moves the wedge assembly along the rails to rotate the user support about the first pivot axis away from the main frame.

2. The machine as claimed in claim 1, wherein the wedge assembly comprises at least one wedge-shaped plate having a front end, a rear end, an upper end, and a lower end, the first travel member being secured to the upper end of the plate and the second travel member being secured to the lower end of the plate, and the plate dimensions being smaller adjacent the front end than the rear end of the plate.

3. The machine as claimed in claim 2, wherein said user support has two base struts each having a first end pivotally linked directly or indirectly to said main frame, each base strut having a downwardly facing second rail, and the wedge assembly comprises at least two spaced wedge plates and at least one upper rod and one lower rod connecting said wedge plates, the first traveling member being secured to said lower rod, and two second travel members being secured to opposite ends of said upper rod for traveling engagement with said respective second rails.

4. The machine as claimed in claim 2, wherein said main frame has two spaced, parallel base struts and said user support has two lower struts each having a first end pivotally linked directly or indirectly to said main frame and facing a respective one of said base struts, each base strut having an upwardly facing first rail and each lower strut having a downwardly facing second rail facing said first rail, and the wedge assembly comprises at least two spaced wedge plates, each wedge plate extending transversely between a respective base strut and lower strut, and at least one upper rod and one lower rod connecting said wedge plates, a pair of first traveling members being secured to opposite ends of said lower rod for traveling engagement with said respective first rails, and a pair of second travel members being secured to opposite ends of said upper rod for traveling engagement with said respective second rails.

5. The machine as claimed in claim 1, wherein the first and second travel members each comprise at least one wheel.

6. The machine as claimed in claim 1, wherein at least one of the travel members comprises a linear bearing.

7. The machine as claimed in claim 6, wherein the other travel member comprises at least one wheel.

8. The machine as claimed in claim 2, wherein the connection device has a first end connected to the front end of said plate.

9. The machine as claimed in claim 1, wherein the exercise arm comprises a leg press member.

10. The machine as claimed in claim 1, wherein the exercise arm comprises an upper body exercise member.

11. The machine as claimed in claim 1, including an exercise resistance for providing an additional, adjustable exercise load.

12. The machine as claimed in claim 11, wherein the user support has a weight peg for receiving weight plates comprising said exercise resistance.

13. The machine as claimed in claim 11, wherein the exercise resistance comprises a weight stack linked to said user support.

14. The machine as claimed in claim 11, wherein the exercise resistance is linked to said wedge assembly.

15. The machine as claimed in claim 1, wherein said connection device comprises a cable or belt linking said wedge assembly to said exercise arm.

16. The machine as claimed in claim 1, wherein said connection device comprises a link arm having a first end pivoted to said wedge assembly and a second end pivoted to said exercise arm.

17. The machine as claimed in claim 1, wherein said connection device comprises a cable and pulley linkage extending from said wedge assembly to said exercise arm and terminating at said user support.

18. The machine as claimed in claim 17, wherein said cable and pulley linkage comprises a pulley on said exercise arm, and a cable or belt extending from said wedge assembly around said pulley and terminated at said user support.

19. The machine as claimed in claim 1, wherein said connection device comprises a first pulley on said exercise arm, a second pulley on said user support, and a cable or belt extending from said wedge assembly around said first and second pulleys and terminating at said exercise arm.

20. The machine as claimed in claim 1, wherein said connection device comprises a pulley on said main frame and a cable or belt extending from said wedge assembly around said pulley and terminating at said exercise arm.

21. The machine as claimed in claim 1, wherein said exercise arm and said user support are both pivoted to said main frame for rotation about the same pivot axis.

22. The machine as claimed in claim 1, wherein said exercise arm and said user support are pivoted to said main frame at spaced positions for rotation about spaced, parallel pivot axes.

23. The machine as claimed in claim 1, wherein said exercise arm is pivoted to said main frame and said user support is pivotally secured to said exercise arm.

24. The machine as claimed in claim 1, wherein said user support is pivoted to said main frame and said exercise arm is pivoted to said user support.

25. An exercise machine, comprising:

a main frame;

a user support pivotally mounted for movement relative to the main frame;

an exercise arm pivotally mounted for movement relative to the main frame;

at least one first slide rail mounted on said main frame;

at least one second slide rail mounted on said user support facing in the direction of said main frame;

a moving wedge assembly between the first and second slide rails, the assembly comprising at least one wedge plate extending generally between the first and second slide rails and having an upper portion, a lower portion, a forward end and a rear end, the forward end being of smaller dimensions than the rear end, a first traveling member mounted on the lower portion of the wedge plate and engaging the first slide rail for movement along the rail, and a second traveling member mounted on the upper portion of the wedge plate and engaging the second slide rail for movement along the second slide rail; and a connection means linking the wedge plate to the exercise arm;

whereby movement of the exercise arm causes the wedge plate to move and the traveling members to travel along the respective rails so as to lift the user support.

* * * * *